US009849327B2

(12) United States Patent
Nikkaran

(10) Patent No.: US 9,849,327 B2
(45) Date of Patent: Dec. 26, 2017

(54) EXERCISE APPARATUS

(71) Applicant: Gorgi Nikkaran, Greenvale, NY (US)

(72) Inventor: Gorgi Nikkaran, Greenvale, NY (US)

( * ) Notice: Subject to any disclaimer, the term of this patent is extended or adjusted under 35 U.S.C. 154(b) by 83 days.

(21) Appl. No.: 14/743,671

(22) Filed: Jun. 18, 2015

(65) Prior Publication Data

US 2015/0343253 A1 Dec. 3, 2015

Related U.S. Application Data

(63) Continuation-in-part of application No. 13/690,193, filed on Nov. 30, 2012, now Pat. No. 9,061,176.

(51) Int. Cl.

| | |
|---|---|
| ***A63B 21/062*** | (2006.01) |
| ***A63B 21/068*** | (2006.01) |
| ***A63B 21/00*** | (2006.01) |
| ***A63B 21/16*** | (2006.01) |
| ***A63B 23/035*** | (2006.01) |
| *A63B 23/02* | (2006.01) |
| *A63B 23/12* | (2006.01) |
| *A63B 23/04* | (2006.01) |

(52) U.S. Cl.

CPC ..... *A63B 21/068* (2013.01); *A63B 21/154* (2013.01); *A63B 21/1663* (2013.01); *A63B 21/4009* (2015.10); *A63B 21/4035* (2015.10); *A63B 23/03541* (2013.01); *A63B 23/1209* (2013.01); *A63B 21/00069* (2013.01); *A63B 23/0205* (2013.01); *A63B 23/0233* (2013.01); *A63B 23/1236* (2013.01); *A63B 2023/0411* (2013.01)

(58) Field of Classification Search

CPC ..... A63B 21/00; A63B 21/06; A63B 21/068; A63B 21/08

USPC ..... 482/23, 38–40, 43, 92–96, 98–99

See application file for complete search history.

(56) References Cited

U.S. PATENT DOCUMENTS

| | | | | | |
|---|---|---|---|---|---|
| 864,188 | A * | 8/1907 | Patterson | A63B 21/068 | 482/143 |
| 1,374,697 | A * | 4/1921 | Heinrich | A63B 21/154 | 482/95 |
| 2,183,265 | A * | 12/1939 | Maloney | A61G 7/065 | 248/322 |
| 2,716,027 | A * | 8/1955 | Gehri | A63B 21/023 | 482/131 |
| 3,118,441 | A * | 1/1964 | Prosser | A61H 1/0218 | 482/122 |
| 3,937,461 | A * | 2/1976 | Lew | A63B 7/02 | 182/6 |

(Continued)

FOREIGN PATENT DOCUMENTS

| | | |
|---|---|---|
| CH | 279927 | 12/1951 |
| GB | 190122932 A | 0/1902 |

(Continued)

*Primary Examiner* — Stephen R Crow
*Assistant Examiner* — Garrett Atkinson
(74) *Attorney, Agent, or Firm* — Welsh Flaxman & Gitler LLC

(57) ABSTRACT

An exercise apparatus includes a mounting assembly and a pulley assembly coupled to the mounting assembly. The pulley assembly includes a first pulley and a second pulley. At least one pulley cable is positioned about the first pulley and the second pulley for movement relative thereto. A body engaging assembly is provided for attachment with the at least one pulley cable.

16 Claims, 17 Drawing Sheets

(56) References Cited

U.S. PATENT DOCUMENTS 3,999,752 A 12/1976 Kupperman et al.
4,052,070 A * 10/1977 Lew ..... A63B 7/00 482/96
4,079,933 A * 3/1978 Everroad ..... A63B 21/0004 482/131
4,109,907 A * 8/1978 Zito ..... A63B 21/06 482/904
4,125,257 A * 11/1978 Lew ..... A63B 7/00 24/129 B
4,205,839 A 6/1980 Best
4,431,184 A * 2/1984 Lew ..... A63B 7/00 482/102
5,048,825 A * 9/1991 Kelly ..... A63B 21/154 482/904
5,129,647 A * 7/1992 Castellanos ..... A63B 21/055 482/124
5,176,602 A * 1/1993 Roberts ..... A63B 7/02 482/129
5,178,590 A * 1/1993 Stephens ..... A63B 7/02 482/23
5,360,384 A * 11/1994 Toensing ..... A63B 69/0064 482/23
5,403,253 A * 4/1995 Gaylord ..... A63B 21/068 482/140
5,713,821 A * 2/1998 Nissen ..... A63B 23/04 482/114
5,885,190 A * 3/1999 Reiter ..... A63B 7/00 482/129
5,944,640 A 8/1999 Larsson
6,113,564 A * 9/2000 McGuire ..... A61H 1/0229 482/131
6,267,711 B1 * 7/2001 Hinds ..... A63B 1/00 482/121
6,554,747 B1 * 4/2003 Rempe ..... A63B 21/04 482/38
6,705,974 B1 * 3/2004 Tardif ..... A63B 21/068 482/148
7,104,935 B2 * 9/2006 Matsuoka ..... A63B 21/0004 482/121
7,255,666 B2 * 8/2007 Cardenas ..... A61H 1/0229 482/143
8,152,704 B2 * 4/2012 Brice ..... A63B 21/00 482/129
8,317,667 B1 11/2012 Thomas
9,061,176 B2 6/2015 Nikkaran
9,326,908 B2 5/2016 Scott
2007/0278464 A1 * 12/2007 Constant ..... B60P 1/5471 254/1
2010/0292056 A1 * 11/2010 Birch ..... A63B 21/00185 482/129
2011/0166003 A1 * 7/2011 Brice ..... A63B 21/00 482/131
2012/0277074 A1 * 11/2012 Zeldakov ..... A63B 21/154 482/126
2014/0005015 A1 * 1/2014 Hester ..... A63B 21/154 482/131

FOREIGN PATENT DOCUMENTS

GB 1326263 A 8/1973
JP S54103964 U 7/1979
WO WO2010120378 A2 10/2010

* cited by examiner

EXERCISE APPARATUS

CROSSS REFERENCE TO RELATED APPLICATION

This application is a continuation-in-part of U.S. patent application Ser. No. 13/690,193, entitled "EXERCISE APPARATUS," filed Nov. 30, 2012, which is currently pending.

BACKGROUND OF THE INVENTION

1. Field of the Invention

This invention relates to an exercise apparatus. More particularly, the invention relates to an exercise apparatus using the weight of the user as resistance in the performance of the exercise.

2. Description of the Related Art

A number of pulley-based exercise devices are known. The devices, however, exhibit a variety of shortcomings in both versatility and ease of use. As such, there remains a need for a pulley-based exercise device offering wide ranging versatility in the muscle groups that may be worked as well as an ease of use encouraging regular and effective exercise by the user. The present invention provides such an exercise device.

SUMMARY OF THE INVENTION

It is, therefore, an object of the present invention to provide an exercise apparatus including a mounting assembly and a pulley assembly coupled to the mounting assembly. The pulley assembly includes a pulley strap member having a first end secured to a first pulley and a second end secured to a second pulley. The pulley strap member is held by a spacing member such that the first end of the pulley strap member and the second end of the pulley strap member are held in a desired spaced relationship for holding the first pulley and the second pulley in a spaced relationship. At least one pulley cable is positioned about the first pulley and the second pulley for movement relative thereto. The at least one pulley cable includes a first end and a second end. A first handle is coupled to the first end of the at least one pulley cable and a body engaging assembly is coupled to the at least one pulley cable.

It is also an object of the present invention to provide an exercise apparatus wherein the mounting assembly includes a first end and a second end. The first end of the mounting assembly includes an abutment member and the second end of the mounting assembly includes a releasable coupling member allowing for selective attachment of the pulley assembly to the mounting assembly.

It is another object of the present invention to provide an exercise apparatus wherein the pulley assembly further includes a coupling strap securing the pulley strap member to the mounting assembly.

It is a further object of the present invention to provide an exercise apparatus wherein the body engaging assembly is a belt shaped and dimensioned for positioning about the waist of a user. The belt includes an elongated body with an inner surface and an outer surface, as well as a first end and a second end. The first end of the elongated body and the second end of the elongated body are provided with mating fastening members allowing for releasable attachment of the belt about the waist of a user.

It is also an object of the present invention to provide an exercise apparatus wherein the spacing member is an elongated planar member having a first end, a second end, and opposed first and second sidewalls extending between the first end and the second end. The spacing member further includes a first slot through which the first end of the pulley strap member passes and a second slot through which the second end of the pulley strap member passes.

It is another object of the present invention to provide an exercise apparatus wherein the first slot and the second slot are mirror images of each other.

It is a further object of the present invention to provide an exercise apparatus wherein each of the first slot and the second slot includes a first slot portion extending between the first sidewall and the second sidewall and being adjacent the first or second end of the spacing member, a second slot portion extending in a direction of the first end and the second end of the spacing member, and a third slot portion extending between the first sidewall and the second sidewall but being inward of either the first end or the second end of the spacing member relative to the first slot portion.

It is also an object of the present invention to provide an exercise apparatus including a mounting assembly and a pulley assembly coupled to the mounting assembly. The pulley assembly includes a first pulley and a second pulley. At least one pulley cable is positioned about the first pulley and the second pulley for movement relative thereto, the at least one pulley cable including a first end and a second end. A first handle is coupled to the first end of the at least one pulley cable and a body engaging assembly is coupled to the at least one pulley cable. The body engaging assembly is a belt shaped and dimensioned for positioning about the waist of a user. The belt includes an elongated body with an inner surface and an outer surface, as well as a first end and a second end. The first end of the elongated body and the second end of the elongated body are provided with first and second mating fastening members, respectively, allowing for releasable attachment of the belt about the waist of a user. The belt also includes a first supplementary attachment member and a second supplementary attachment member secured to opposite sides of the belt on opposite sides of the first and second mating fastening members.

It is another object of the present invention to provide an exercise apparatus wherein each of the first and second supplementary attachment members includes a releasable coupling member shaped and dimensioned for selective engagement with mating releasable coupling members.

It is a further object of the present invention to provide an exercise apparatus wherein the at least one pulley cable includes a releasable coupling member for selective engagement with either of the first or second supplementary attachment members.

It is also an object of the present invention to provide an exercise apparatus further including a central pulley assembly including a releasable coupling member for selective engagement with either of the first or second supplementary attachment members.

It is a further object of the present invention to provide an exercise apparatus wherein the short strap member includes a first end provided with a releasable coupling member adapted for attachment to the releasable coupling member of the first supplementary attachment member and a second end provided with a releasable coupling member adapted for attachment to the releasable coupling member of the second supplementary attachment member.

It is also an object of the present invention to provide an exercise apparatus wherein straps, adjustable in length, secure the releasable coupling members of the first and second supplementary attachment members to the belt.

It is another object of the present invention to provide an exercise apparatus including a mounting assembly and a pulley assembly coupled to the mounting assembly. The pulley assembly includes a first pulley and a second pulley. At least one pulley cable is positioned about the first pulley and the second pulley for movement relative thereto. The at least one pulley cable includes a first end and a second end. A first handle is coupled to the first end of the at least one pulley cable and a body engaging assembly is coupled to the at least one pulley cable. The exercise apparatus also includes a central pulley assembly including a releasable coupling member for selective engagement with the body engaging assembly.

It is a further object of the present invention to provide an exercise apparatus wherein the central pulley assembly includes a short strap member to which a central pulley is secured.

It is also object of the present invention to provide an exercise apparatus wherein the short strap member includes a first end provided with a releasable coupling member adapted for attachment to the body engaging assembly and a second end provided with a releasable coupling member adapted for attachment to the body engaging assembly.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
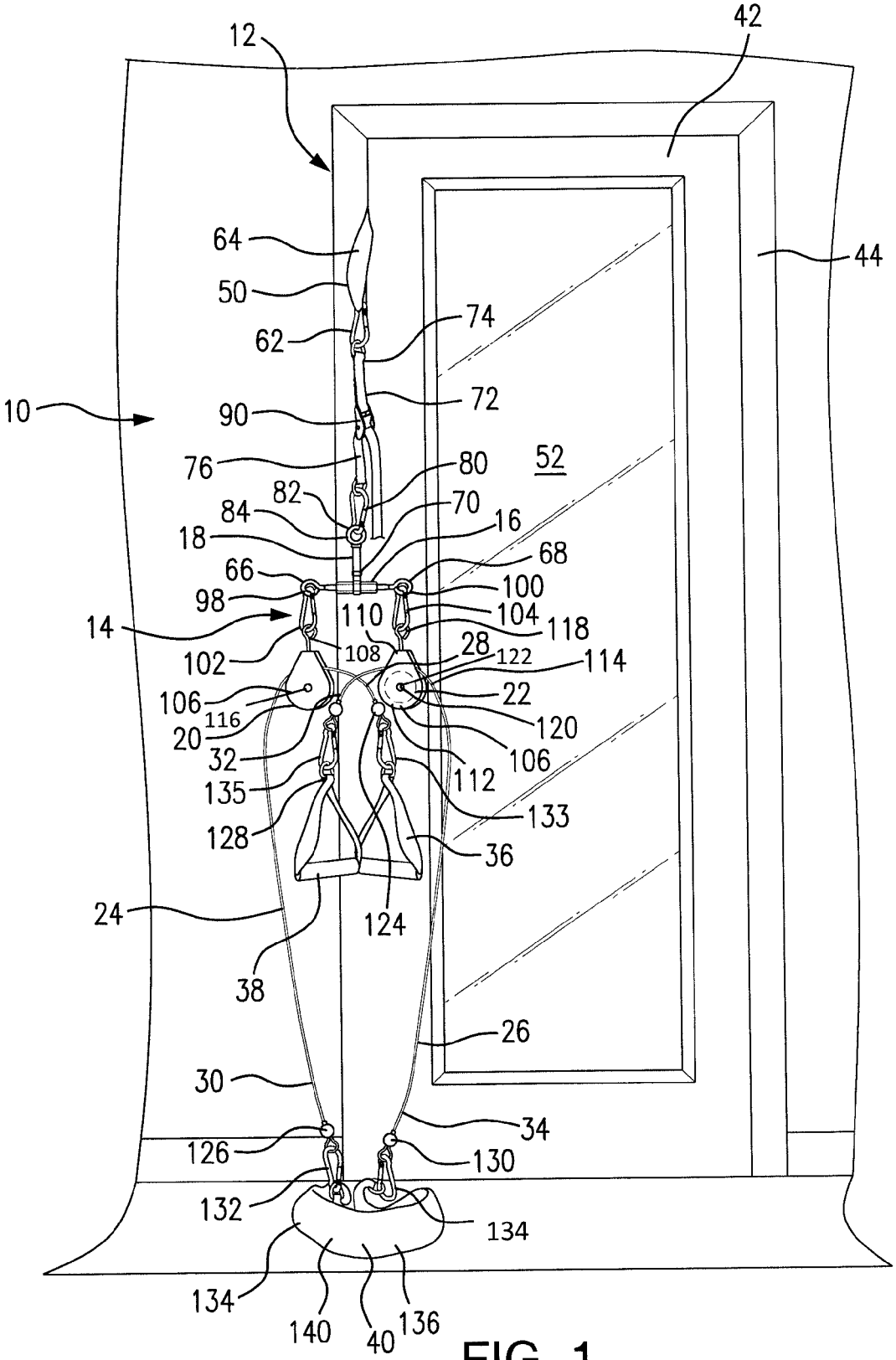
FIG. 1 is a perspective view of the exercise apparatus in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to the various figures, an exercise apparatus 10 using the weight of the individual exercising as a resistance source is disclosed. The exercise apparatus 10 includes a mounting assembly 12 and a pulley assembly 14 coupled to the mounting assembly 12. The pulley assembly 14 includes a support bar 16 from which a coupling bar 18 extends. The coupling bar 18 is used in releasably securing the pulley assembly 14 to the mounting assembly 12. The pulley assembly 14 also includes a first pulley 20 and a second pulley 22 extending from the support bar 16. A first pulley cable 24 is positioned about the first pulley 20 for movement relative thereto and a second pulley cable 26 is positioned about the second pulley 22 for movement relative thereto. The first pulley cable 24 includes a first end 28 and a second end 30 and the second pulley cable 26 includes a first end 32 and a second end 34. A first handle 36 is coupled to the first end 28 of the first pulley cable 24 and a second handle 38 is coupled to the first end 32 of the second pulley cable 26. A body engaging assembly 40 is coupled to both the second end 30 of the first pulley cable 24 and the second end 34 of the second pulley cable 26.

Figure 2:
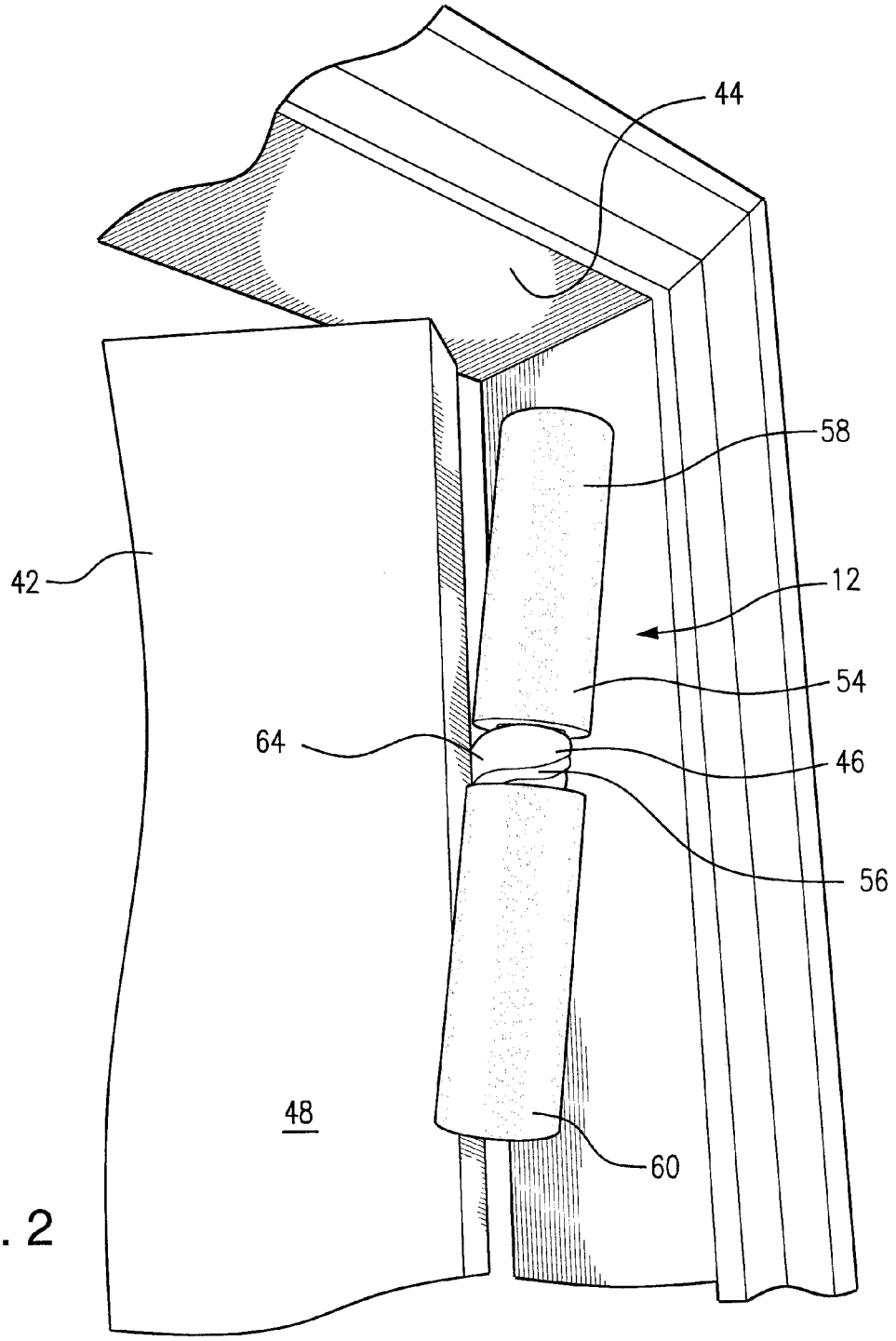
FIG. 2 is a detailed perspective view of the abutment member of the mounting assembly of the present exercise apparatus.
Figure 3:
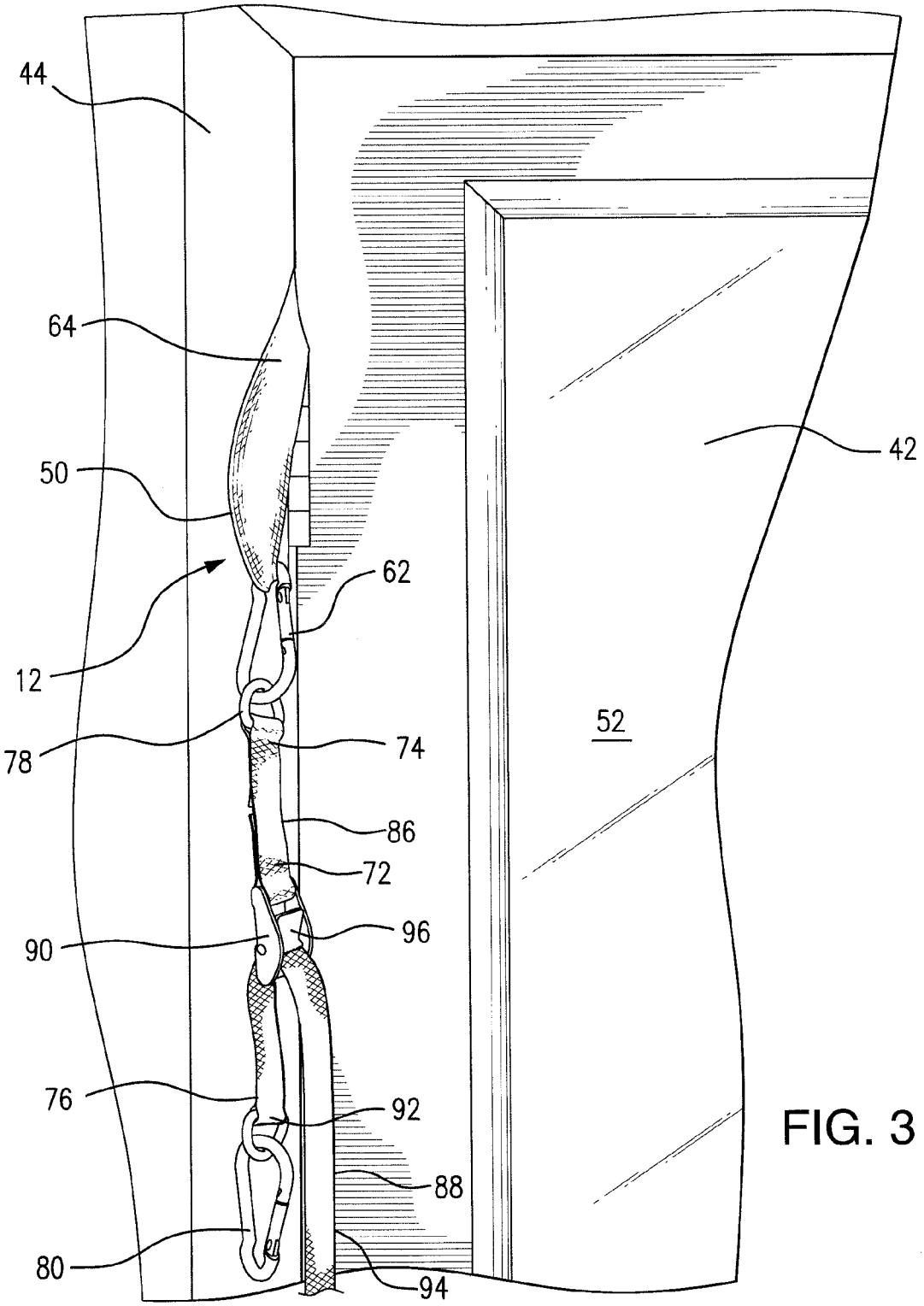
FIG. 3 is a detailed perspective view of the adjustable coupling strap used in securing the pulley assembly to the mounting assembly.

Referring now to FIGS. 1, 2 and 3, the mounting assembly 12 is adapted for selective attachment to a door 42 by positioning the mounting assembly 12 between the door 42 and the door frame 44 such that a first end 46 of the mounting assembly 12 is positioned on an exterior side 48 of the door 42 during exercise and a second end 50 of the mounting assembly 12 is positioned on an interior side 52 (that is, within the room where the user will be exercising) of the door 42 during exercise. The first end 46 is therefore provided with an abutment member 54 in the form of an elongated bar 56 having enlarged cushioned end members 58, 60 of a size such that the elongated bar 56 is too big to pass within the space between the door 42 and the door frame 44. The second end 50 of the mounting assembly 12 is provided with a releasable coupling member 62 in the form of a carabiner, which, as will be appreciated based upon the following disclosure, allows for selective attachment of the pulley assembly 14 to the mounting assembly 12. The releasable coupling member 62 at the second end 50 of the mounting assembly 12 is secured to the abutment member 54 at the first end 46 of the mounting assembly 12 by a strap 64 shaped and dimensioned to pass between the exterior side 48 of the door 42 and the interior side 52 of the door 42 with the strap 64 fitting within the space between the door 42 and the door frame 44.

Figure 4:
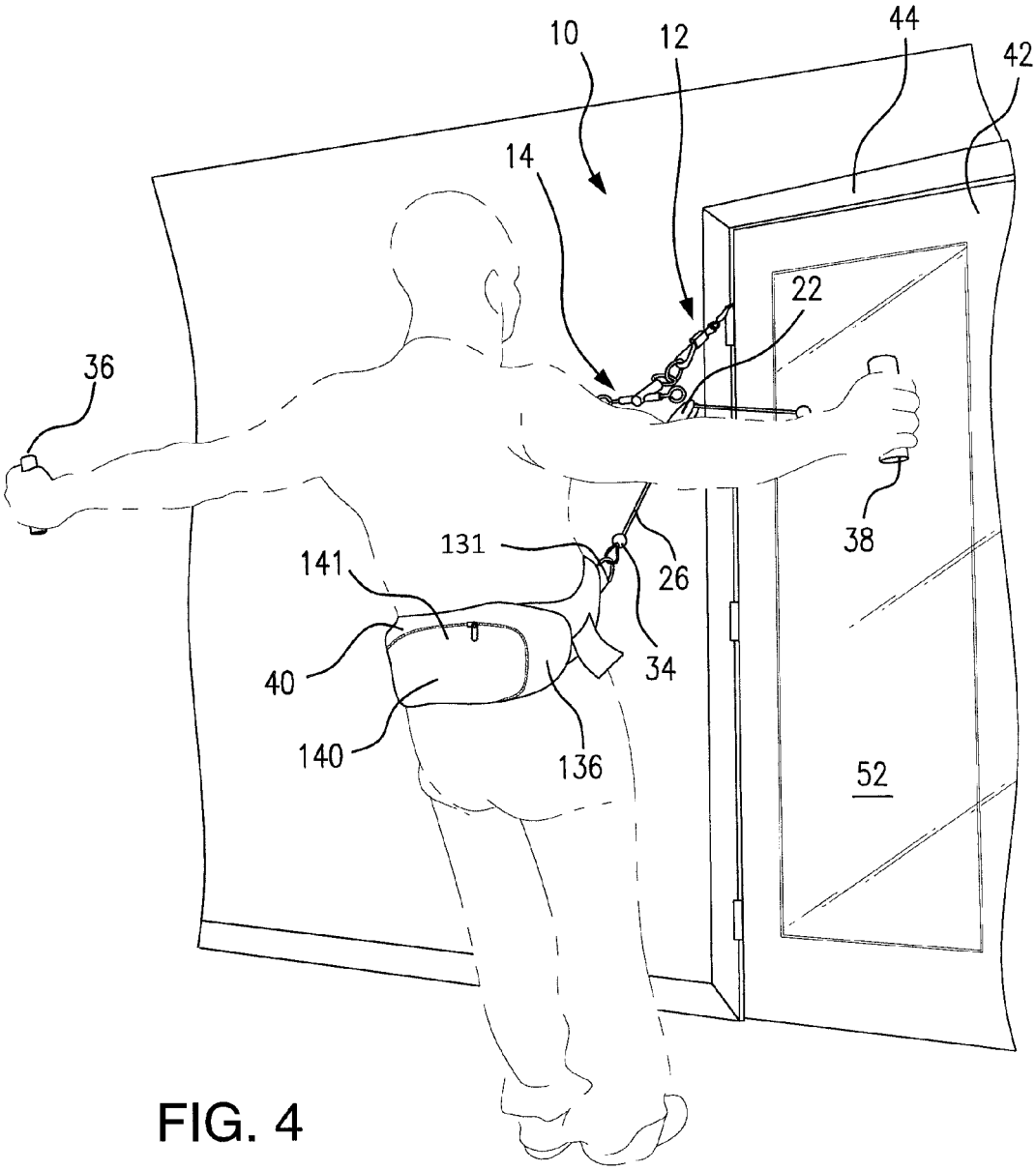
FIGS. 4 and 5 show the exercise apparatus in use.
Figure 5:
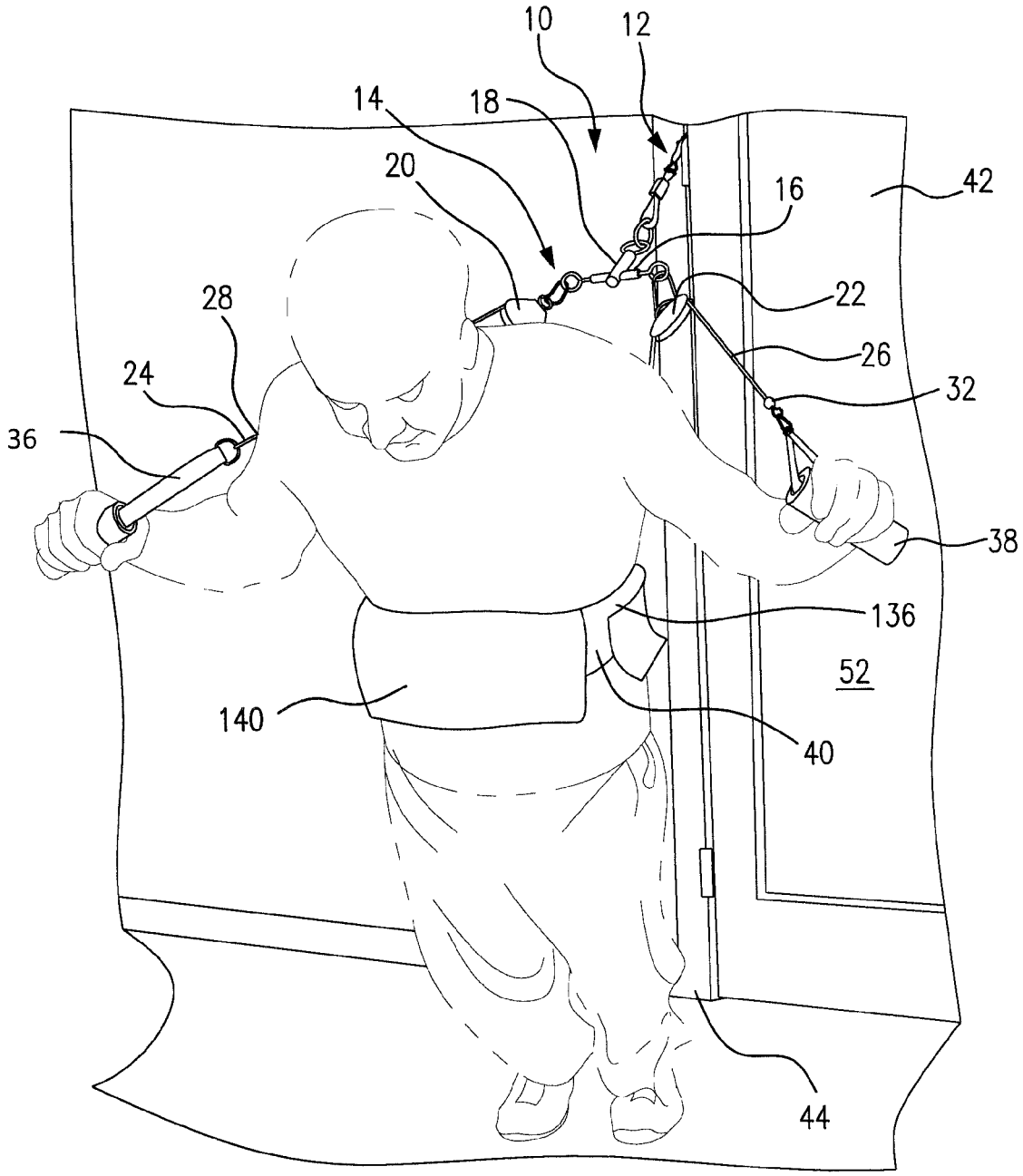
Figure 6:
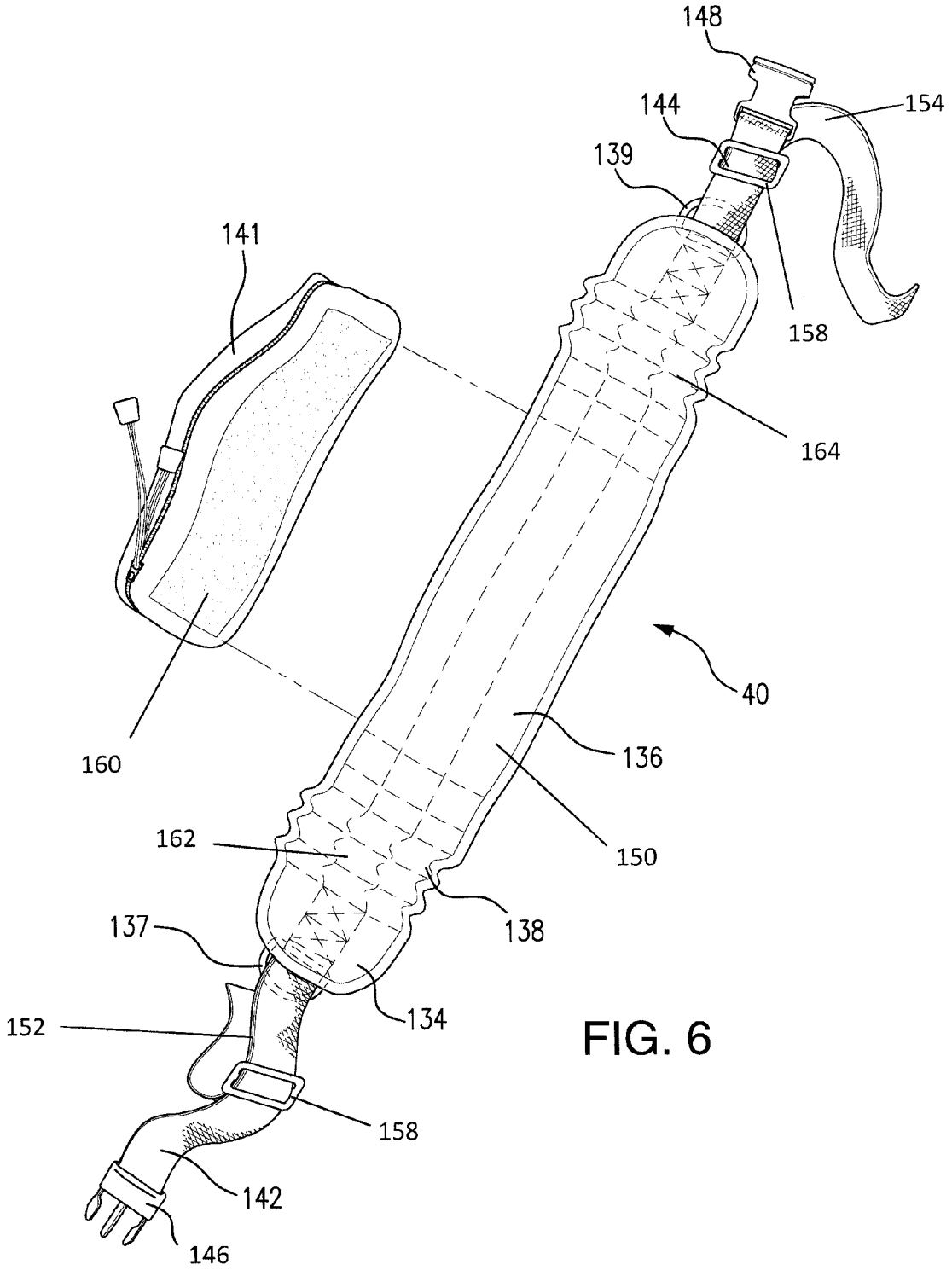
FIG. 6 is a perspective view of the belt used in conjunction with the present exercise apparatus.

Turning now to the pulley assembly 14 as shown best with reference to FIGS. 1, 4 and 5, the pulley assembly 14 includes a support bar 16 from which the coupling bar 18 and the first and second pulleys 20, 22 extend. The support bar 16 includes a first end 66 and second end 68, with a central section 70 between the first end 66 and the second end 68. The coupling bar 18 is secured to the support bar 16 at approximately the longitudinal center of the support bar 16 and extends in a direction perpendicular to the longitudinal axis of the support bar 16.

An adjustable coupling strap 72 is used in securing the pulley assembly 14 to the mounting assembly 12, in particular, in securing the pulley assembly 14 to the releasable coupling member 62 at the second end 30 of the mounting assembly 12. The adjustable coupling strap 72 includes a first end 74 and a second end 76. The first end 74 of the adjustable coupling strap 72 is provided with a coupling ring 78 (for example, an O-ring) shaped and dimensioned for selective attachment to the releasable coupling member 62 and the second end 76 of the coupling strap 72 is provided with a releasable coupling member 80 in the form of a carabiner that is shaped and dimensioned for selective coupling with an O-ring 82 at the free end 84 of the coupling bar 18. In this way, the adjustable coupling strap 72 may be selectively secured between the pulley assembly 14 and the mounting assembly 12 to secure the functional components of the present exercise apparatus 10 to the door 42.

As mentioned above, the coupling strap 72 is adjustable. In accordance with a preferred embodiment, this is achieved by forming the coupling strap 72 from two strap members 86, 88 with a buckle 90 positioned between. The first strap member 86, which forms the first end 74 of the coupling strap 72 is of a fixed length and is fixedly secured to the O-ring 78 and the buckle 90. The second strap member 88, which forms the second end 76 of the coupling strap 72 is of an adjustable operating length and passes through the buckle 90 for selective attachment thereto in a manner allowing for adjustment of the effective length of the adjustable coupling strap 72. The second strap member 88 includes a first end 92 to which the releasable coupling member 80 is secured and a free, second end 94. The second strap member 88 is moved and locked relative to the buckle 90 so as to adjust the length of the second strap member 88 extending between the buckle 90 and the releasable coupling member 80. It is appreciated the buckle 90 is a conventional spring based locking buckle using a pivoting and spring biased latching member 96 to control movement of the second strap member 88 relative to the buckle 90.

The pulley assembly 14 also includes a first pulley 20 and a second pulley 22 extending from the support bar 16. The first pulley 20 is secured to the first end 66 of the support bar 16 in a manner permitting a full range of motion of the first pulley 20 relative to the support bar 16. Similarly, the second pulley 22 is secured to the second end 68 of the support bar 16 in a manner permitting a full range of motion of the second pulley 22 relative to the support bar 16. A full range of motion, as well as releasable attachment of the first and second pulleys 20, 22 to the respective ends 66, 68 of the support bar 16, is achieved by providing the first end 66 and the second end 68 of the support bar 16 with first and second O-rings 98, 100. The first and second pulleys 20, 22 are secured to the O-rings 98, 100 using first and second releasable coupling members 102, 104, in particular, carabiners, from which the first and second pulleys 20, 22 extend.

Considering now the first and second pulleys 20, 22, they are conventional pulleys and may take various forms. In accordance with a preferred embodiment, each of the first and second pulleys 20, 22 includes a U-shaped frame member 106. The U-shaped frame member 106 includes a first end 108 at the connection member 110 coupling the first and second arms 112, 114 at a second end 116 at the free ends of the first and second arms 112. The first end 108 includes an O-ring 118 to which the releasable coupling member 102, 104 is secured and the second end 116 includes a pivot pin 120 extending between the free ends of the first and second arms 112, 114 with a wheel 122 rotating upon the pivot pin 120.

As mentioned above, a first pulley cable 24 is secured to the first pulley 20 and a second pulley cable 26 is secured to the second pulley 22. With reference to the first pulley cable 24, it passes within the space defined by the U-shaped frame member 106 between the first end 108, which is closed by the connection member 110, and the second end 116, which is closed by the pivot pin 120 and wheel 122. The first pulley cable 24 is retained within the spaced defined by the U-shaped frame member 106 by securing a first locking ball 124 adjacent the first end 28 of the first pulley cable 24 and a second locking ball 126 adjacent the second end 30 of the first pulley cable 24. The first and second locking balls 124, 126 are larger than the space defined by the U-shaped frame member 106 and the respective first and second ends 28, 30 of the first pulley cable 24 may not be pulled through the space defined by the U-shaped frame member 106 so as to effectively remove the first pulley cable 24 from the first pulley 20. Similarly, the second pulley cable 26 is retained within the spaced defined by the U-shaped frame member 106 by securing a first locking ball 128 adjacent the first end 32 of the second pulley cable 26 and a second locking ball 130 adjacent the second end 34 of the second pulley cable 26. The first and second locking balls 128, 130 are larger than the space defined by the U-shaped frame member 106 and the respective first and second ends 32, 34 of the second pulley cable 26 may not be pulled through the space defined by the U-shaped frame member 106 so as to effectively remove the first pulley cable 24 from the first pulley 20.

The first pulley cable 24 includes a first end 28 and second end 30. A first handle 36 is coupled to the first end 28 of the first pulley cable 24, at a position beyond the previously discussed first locking ball 124. The body engaging assembly 40 is coupled to the second end 30 of the first pulley cable 24 at a position beyond the previously discussed second locking ball 126. The first handle 36 and the body engaging assembly 40 are releasably secured to the first pulley cable 24. In accordance with a preferred embodiment the first and second ends 28, 30 of the first pulley cable 24, as well as the first handle 36 and the body engaging assembly 40 are provided with O-rings that are releasably connected together as described above using releasable coupling members 132, 133 in the form of carabiners. With regard to the second pulley cable 26, it includes a first end and second end 32, 34. The second handle 38 is coupled to the first end 32 of the second pulley cable 26, at a position beyond the previously discussed first locking ball 128. The body engaging assembly 40 is coupled to the second end 34 of the second pulley cable 26 at a position beyond the previously discussed second locking ball 130. The second handle 38 and the body engaging assembly 40 are releasably secured to the first pulley cable 24. In accordance with a preferred embodiment the first and second ends 32, 34 of the second pulley cable 26, as well as the second handle 38 and the body engaging assembly 40 are provided with O-rings that are releasably connected together as described above using releasable coupling members 134, 135 in the form of carabiners. Further versatility may be achieved through the provision of gripping balls formed adjacent the first ends of the first and second pulley cables. These gripping balls would allow for exercises where handles are not optimal and permit a user to grip the first end of the respective first and second pulley cables at positions slightly displaced from the actual ends of the cables where a shorter effective cable length is desired.

Considering now the body engaging assembly 40, it is preferably a belt 134 shaped and dimensioned for positioning about the waist of a user as he or she exercises. As such, the belt 134 includes an elongated body 136 with an inner surface 138 and an outer surface 140, as well as a first end 142 and a second end 144. The respective first end 142 and second end 144 are provided with first and second mating fastening members 146, 148 allowing for releasable attachment of the belt 134 about the waist of a user. The belt 134 is primarily composed of a central wide strap member 150 from which adjustable straps 152, 154 (using conventional buckles 158 to allow for adjustment) extend at both the first end 142 of the belt 134 and the second end 144 of the belt 134. In accordance with a preferred embodiment, the ends of the wide strap member 150 are provided with elastic allowing for stretching of the wide strap member 150 to accommodate various body positions for different exercises, as well as various body sizes without the need for the larger scale adjustments permitted by the adjustable straps 152, 154.

With regard to the attachment of the second ends 30, 34 of the first and second pulley cables 26, 28 to the elongated body 136 of the body engaging assembly 40, the elongated body 136 is constructed such that the O-rings 137, 139 used in securing the second ends 30, 34 of the first and second pulley cables 24, 26 to the elongated body 136 are positioned along the outer surface 140 of the elongated body 136, that is, the surface of the elongated body 136 facing away from the user when the body engaging assembly 40 is properly positioned about the waist of the user.

More particularly, the O-rings 137, 139 are positioned such that they are substantially aligned with opposed sides of the body along front plane of the user's body; that is, the O-rings, 137, 139, when the belt 134 is properly secured about the user will be positioned at the left and right sides of the body As will be further appreciated when the variety of uses for the present exercise apparatus is explained below, and as discussed above, the belt 134 includes an elastic feature allowing for positioning of the belt 134 at various locations along the abdomen and torso of the user. In particular, the belt 134 includes a left side panel 162 adjacent the first end of belt 134 and a right side panel 164 adjacent the second end of the belt 134. Each of the first side panel and the right side panel is provided with an elastic member allowing for controlled expansion thereof. In addition, it is appreciated additional security can be achieved by extending a tether from the mounting assembly 40 to the belt 134.

In use, the present exercise may be thought of as "a gym in a bag." In particular, the body engaging assembly 40 is provided with a zippered pouch 141 in which the various functional components of the present exercise apparatus 10 may be stored. In accordance with a preferred embodiment, the pouch 141 is secured to the belt 134 using hook and loop fasteners 160 allowing for selective attachment thereto.

When it is time to exercise, the user removes the various functional components, that is, the mounting assembly 12 and the pulley assembly 14. The abutment member 54 is positioned on the exterior side of the door 42 and the strap 64 is slid between the door 42 and the door frame 44. In particular, the strap 64 is slid between the door 42 and the door frame 44 from the top of the door 42 such that the strap 64 sits upon the upper hinge connecting the door 42 to the door frame 44.

With the abutment member 54 positioned on the exterior of the door 42 and the strap 64 extending to the interior of the door 42, the adjustable coupling strap 72 is secured to the strap 64 and the pulley assembly 14 is secured to the adjustable coupling strap 72. The user then secures the body engaging assembly about his or her torso or waist depending upon the exercise. The second ends 30 of the pulley cables are then secured to the attachment points of the body engaging assembly 40. At this point, the user may adjust the adjustable coupling strap 72 to suit the specific exercise he or she plans to perform. In particular, the adjustable coupling strap 72 is adjusted such that the user may use his or her complete weight from the ground up, meaning that he/she will lift his/her whole weight from the ground up, but spreading the load all over his/her body. Thereafter, the user may grip the handles and begin exercising.

As a result, the user becomes the weight and can either lean forward or backward while performing various exercises. For example, the present exercise apparatus will allow the user to do back, squats, shoulders, biceps, triceps etc. with his/her body functioning as the resistance weight.

In the case where the user desires to do a chest workout, he/she may lean forward with the belt 134 positioned at a comfortable position as shown in FIG. 5. When he/she is doing butterflies or he/she is doing push-ups or shoulders he/she can lean, he/she can go down and come up in one motion using his/her whole body. Because he/she is at an angle, his/her body has to flex all its front muscles to keep him/her straight up. You can do back exercises, upper chest exercises, lower chest exercises, sit-ups etc.

Referring to FIGS. 7 to 20 an alternate embodiment of the present invention is disclosed. As with the prior embodiment, the exercise apparatus 1010 includes a mounting assembly 1012 and a pulley assembly 1014 coupled to the mounting assembly 1012. The pulley assembly 1014 includes an elongated coupling strap 1031 and a support assembly from which a strap supporting first and second pulleys 1020, 1022 extends. A first pulley cable 1024 is positioned about the first pulley 1020 for movement relative thereto and a second pulley cable 1026 is positioned about the second pulley 1022 for movement relative thereto. The first pulley cable 1024 includes a first end 1028 and a second end 1030 and the second pulley cable 1026 includes a first end 1032 and a second end 1034. A first handle 1036 is coupled to the first end 1028 of the first pulley cable 1024 and a second handle 1038 is coupled to the first end 1032 of the second pulley cable 1026. A body engaging assembly 1040 is selectively coupled to both the second end 1030 of the first pulley cable 1024 and the second end 1034 of the second pulley cable 1026.

Figures 7, 8, 9, 10:
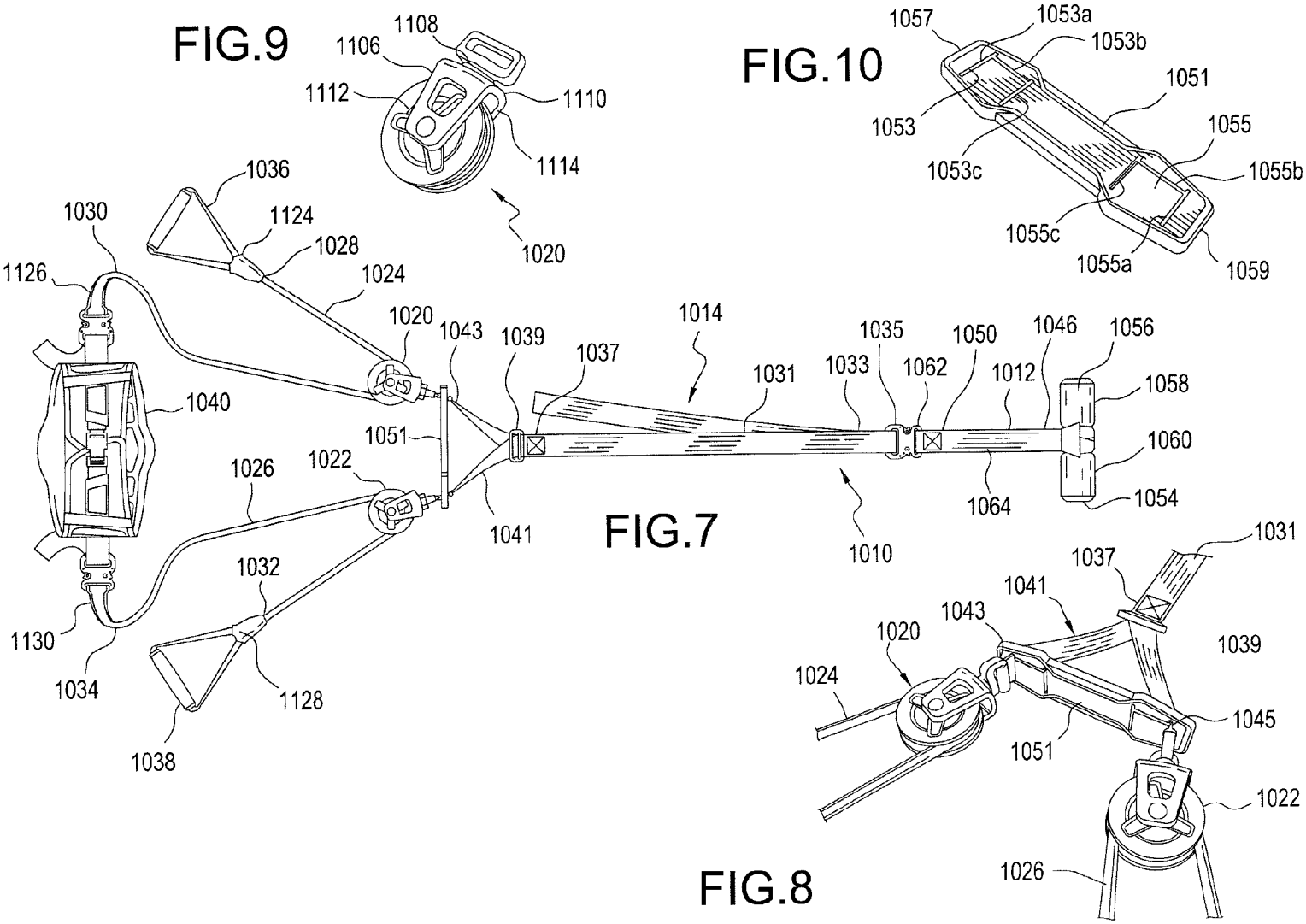
FIG. 7 is a top plan view of an exercise apparatus in accordance with an alternate embodiment of the present invention.
FIG. 8 is a detailed perspective view of the pulley assembly in accordance with the embodiment of FIG. 7.
FIG. 9 is a detailed perspective view of a pulley in accordance with the embodiment of FIG. 7.
FIG. 10 is a perspective view of the spacing member in accordance with the embodiment of FIG. 7.
Figure 11:
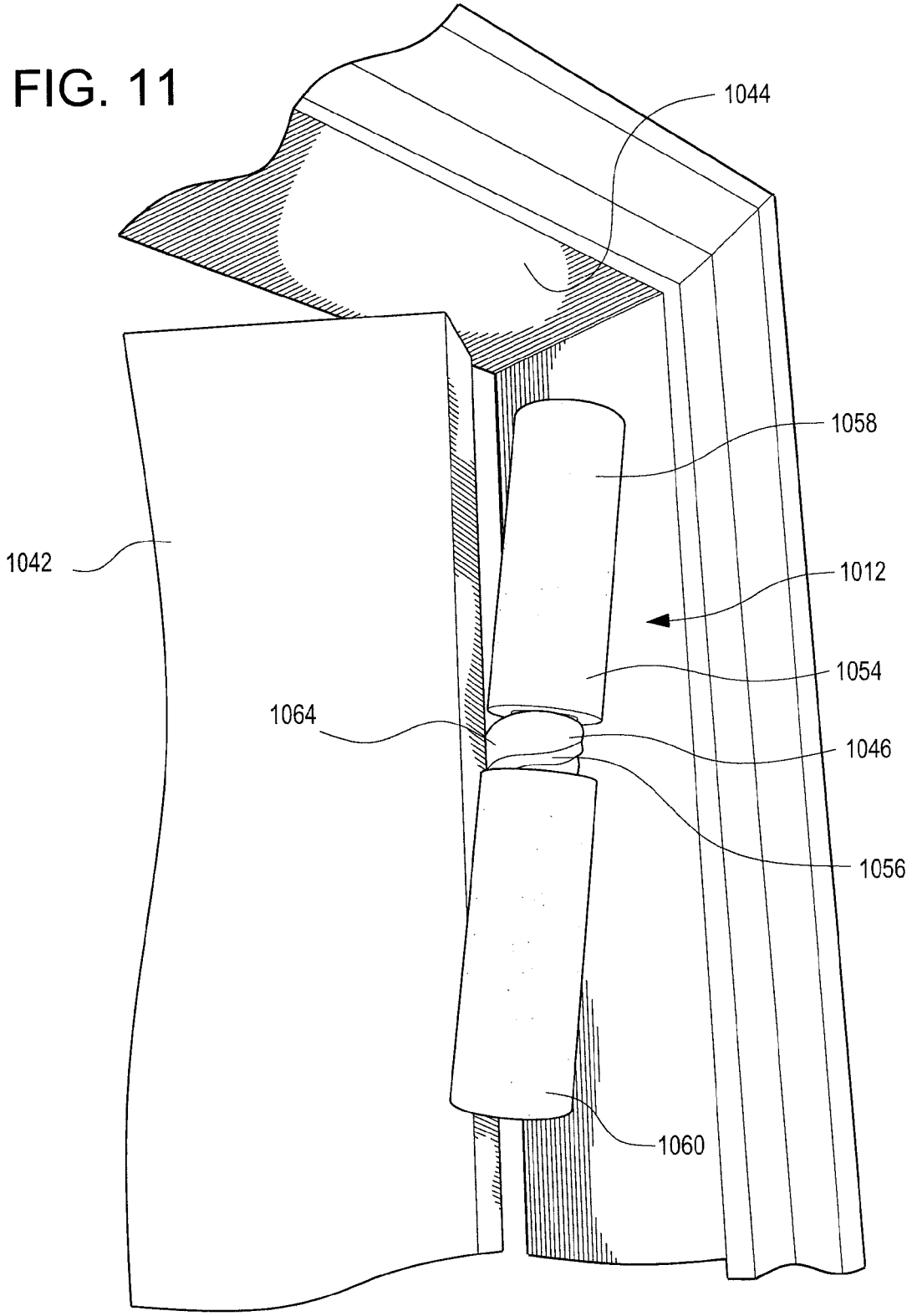
FIG. 11 is a detailed perspective view of the abutment member of the mounting assembly of the present exercise apparatus.
Figure 12:
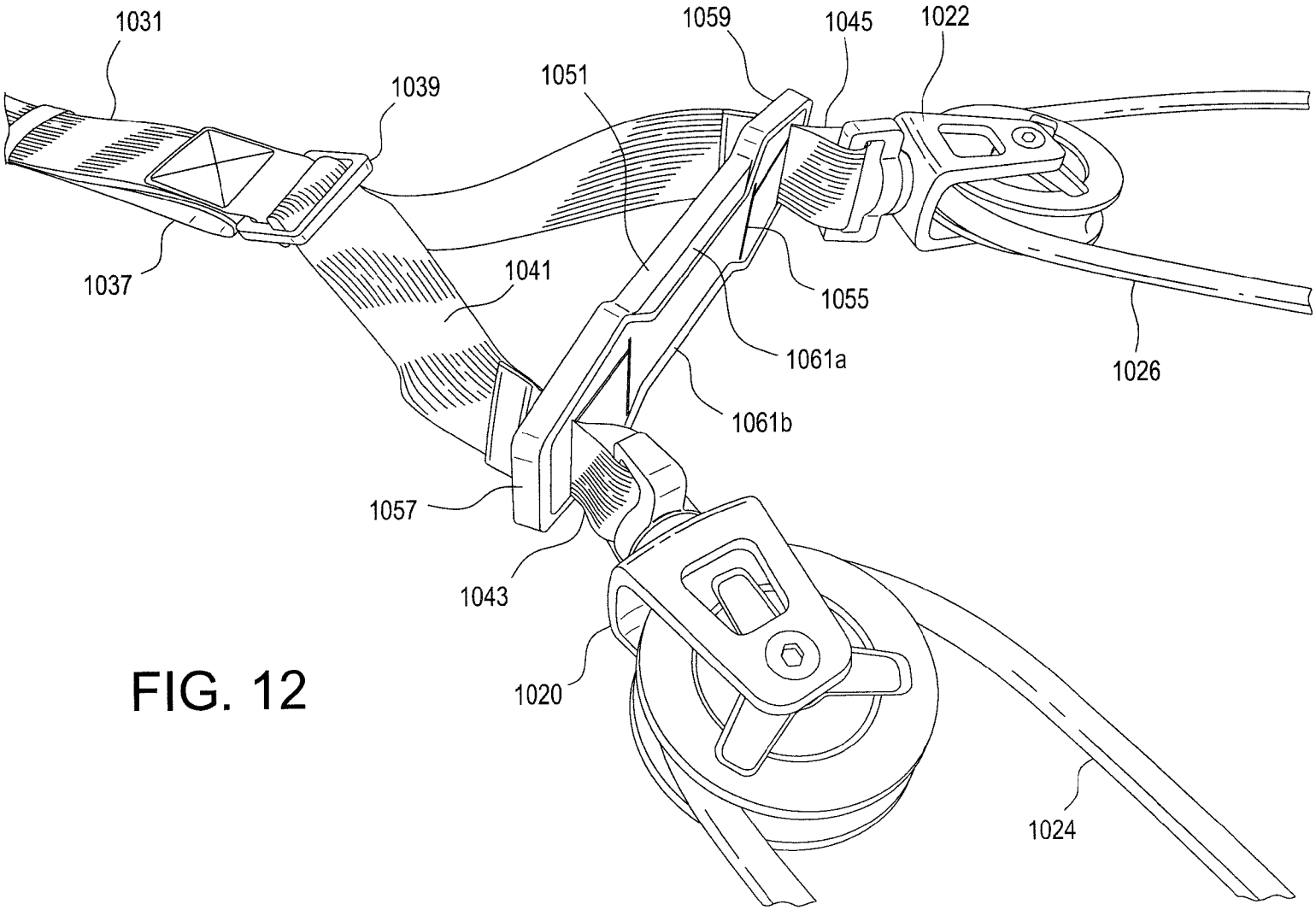
FIG. 12 is another detailed perspective view of the pulley assembly in accordance with the embodiment of FIG. 7.
Figure 13:
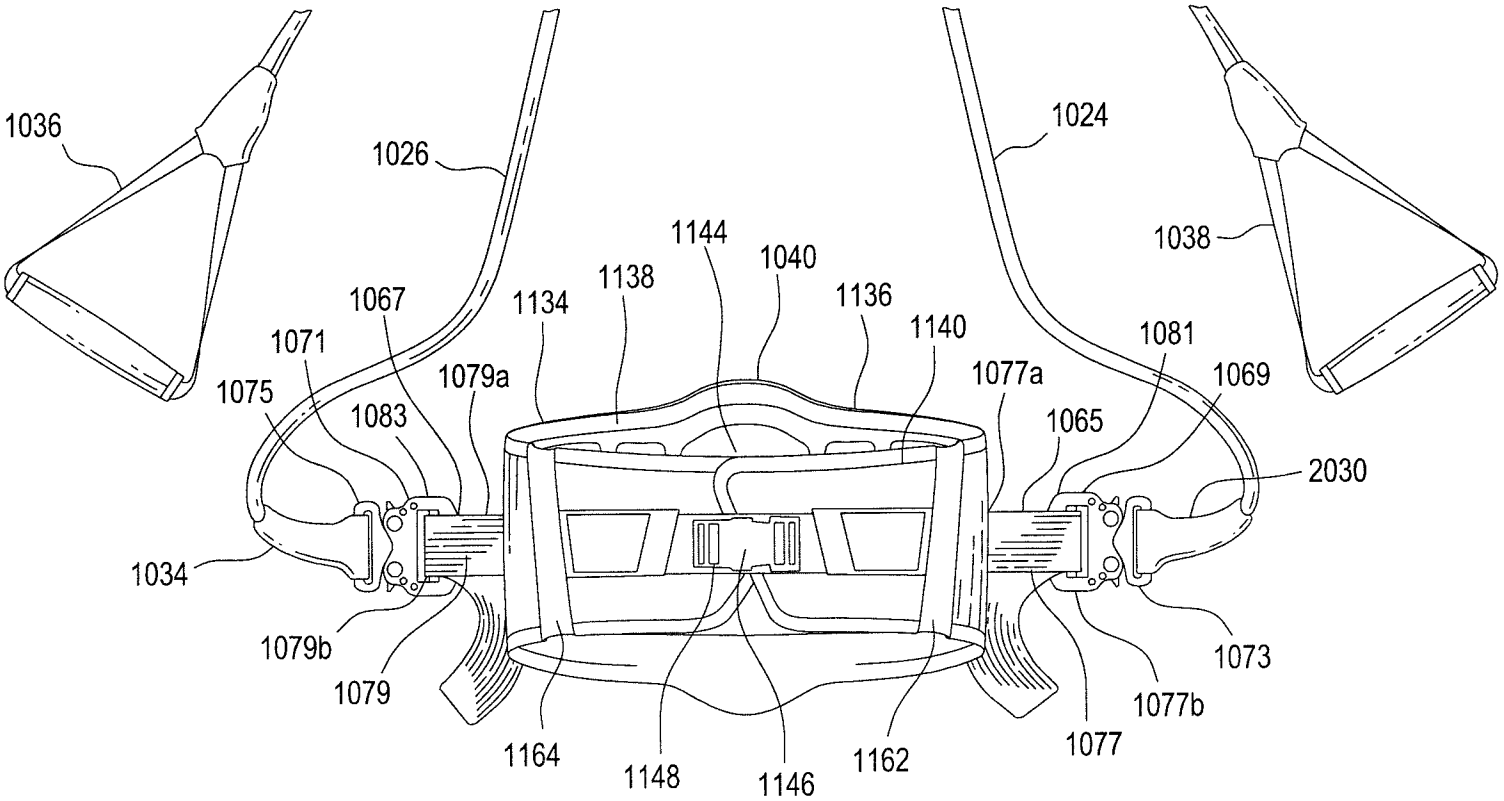
FIG. 13 is a front plan view of the body engaging assembly in accordance with the embodiment of FIG. 7.
Figure 14:
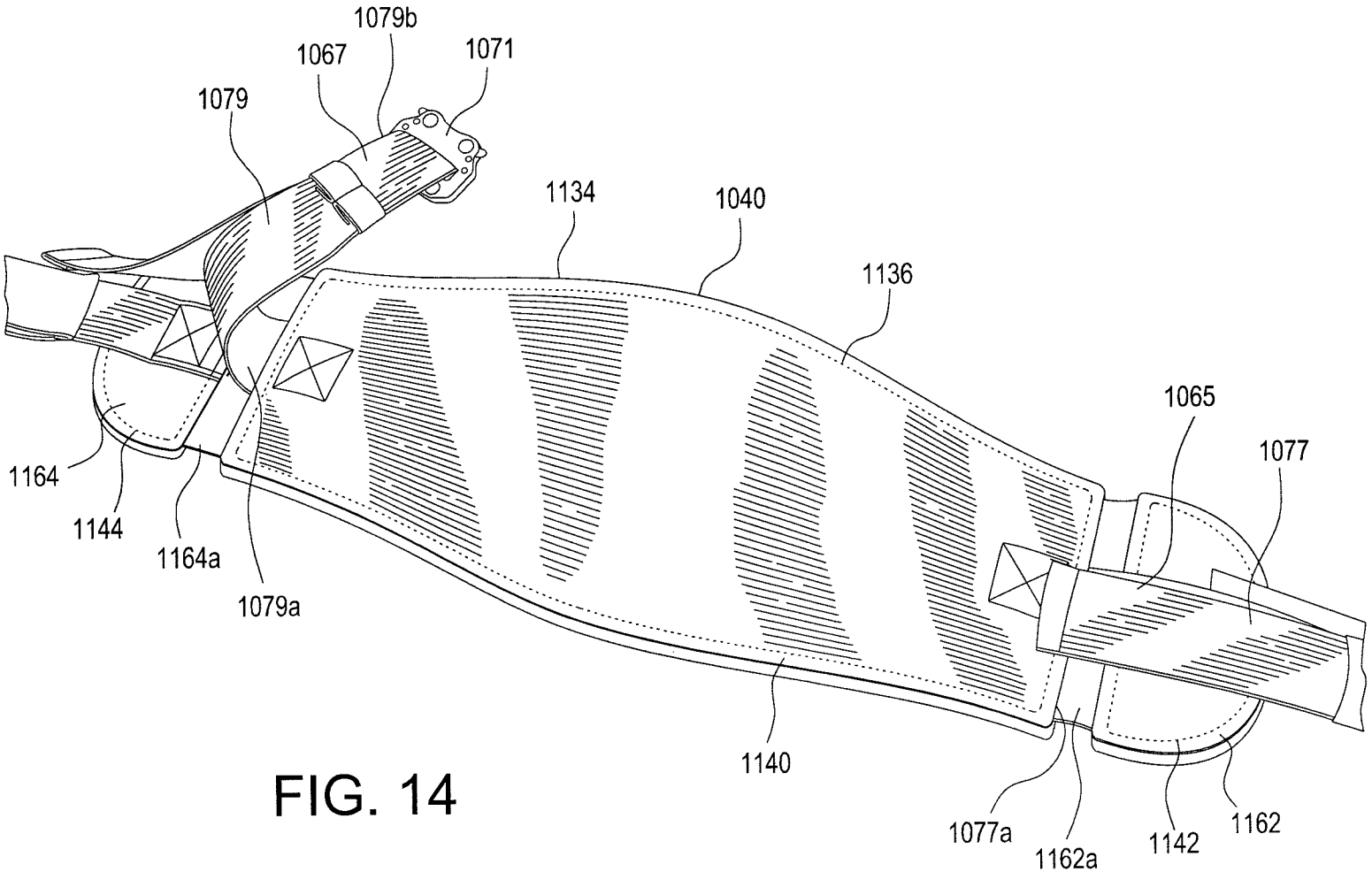
FIG. 14 is a detailed top plan view of the body engaging assembly in accordance with the embodiment of FIG. 7.
Figure 15:
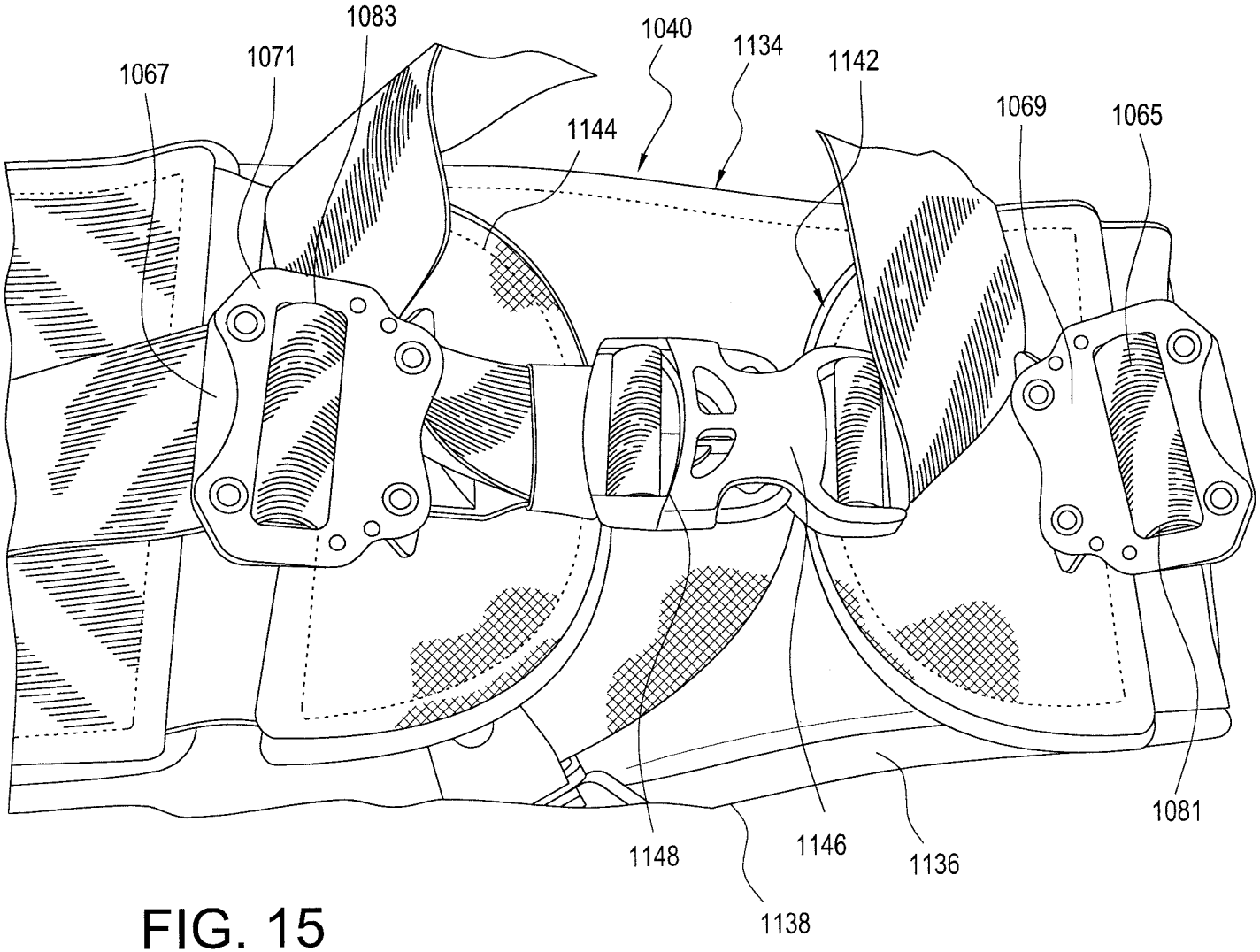
FIG. 15 is a detailed perspective view of the body engaging assembly (in its closed configuration) in accordance with the embodiment of FIG. 7.

Referring now to FIGS. 7 and 11, the mounting assembly 1012 is adapted for selective attachment to a door 1042 by positioning the mounting assembly 1012 between the door 1042 and the door frame 1044 such that a first end 1046 of the mounting assembly 1012 is positioned on an exterior side 1048 of the door 1042 during exercise and a second end 1050 of the mounting assembly 1012 is positioned on an interior side (not shown; that is, within the room where the user will be exercising) of the door 1042 during exercise. The first end 1046 is provided with an abutment member

1054 in the form of an elongated bar 1056 having enlarged cushioned end members 1058, 1060 of a size such that the elongated bar 1056 is too big to pass within the space between the door 1042 and the door frame 1044. The second end 1050 of the mounting assembly 1012 is provided with a releasable coupling member 1062, which, as will be appreciated based upon the following disclosure, allows for selective attachment of the pulley assembly 1014 to the mounting assembly 1012. The releasable coupling member 1062 at the second end 1050 of the mounting assembly 1012 is secured to the abutment member 1054 at the first end 1046 of the mounting assembly 1012 by a strap 1064 shaped and dimensioned to pass between the exterior side 1048 of the door 1042 and the interior side 1052 of the door 1042 with the strap 1064 fitting within the space between the door 1042 and the door frame 1044.

Turning now to the pulley assembly 1014 as shown best with reference to FIGS. 7, 8, 9 and 12, the pulley assembly 1014 includes an elongated coupling strap 1031. The coupling strap 1031 includes a first end 1033 having a releasable coupling member 1035 shaped and dimensioned for engagement with a releasable coupling member 1062 at the second end 1050 of the mounting assembly 1050. The releasable coupling member 1035 at the first end 1033 of the coupling strap 1031 includes an adjustment mechanism 1049 allowing one to adjust the effective length from the first end 1033 of the coupling strap 1031 to the second end 1037 of the coupling strap 1031. The adjustment mechanism 1037 employed in accordance with the preferred embodiment is a dual slot arrangement known to those skilled in the art wherein a strap is passed through adjacent slots in a tortuous path to allow for selective adjustment without sacrificing strength necessary to hold the strap at a desired length.

At the second end 1037 of the coupling strap 1031 is located a buckle 1039 having a pulley strap member 1041 passing therethrough such that the pulley strap member 1041 has a first end 1043 secured to the first pulley 1020, and a second end 1045 secured to the second pulley 1022. The pulley strap member 1041 is held by a spacing member 1051 such that the first end 1043 of the pulley strap member 1041 and the second end 1045 of the pulley strap member 1041 are held in a desired spaced relationship for holding the first and second pulleys 1020, 1022 in a similar spaced relationship.

The spacing member 1051 is an elongated planar member having a first end 1057, a second end 1059, and opposed sidewalls 1061*a*, 1061*b* extending between the first end 1057 and the second end 1059. Adjacent the first end 1057, the spacing member 1051 is provided with a first slot 1053 through which the first end 1043 of the pulley strap member 1041 passes. Similarly, a second slot 1055 is provided adjacent the second end 1059 of the spacing member 1051. The second slot 1055 is also shaped and dimensioned to permit the passage of the pulley strap member 1041 therethrough. The first and second slots 1053, 1055 are mirror images of each other and include a continuous slot formation. The continuous slot formation is composed of a first slot portion 1053*a*, 1055*a*, a second slot portion 1053*b*, 1055*b*, and a third slot portion 153*c*, 155*c*. The first slot portion 1053*a*, 1055*a* extends between the first sidewall 1061*a* and the second sidewall 1061*b* and being adjacent the first or second end 1057, 1059 of the spacing member 1051. The third slot portion 153*c*, 155*c* extends between the first side wall 1061*a* and the second sidewall 1061*b* of the spacing member 1051 but is positioned inwardly (that is, closer to the center of the spacing member 1051) of either the first end 1057 or second end 1059 of the spacing member 1051. The lateral second slot portion 1053*b*, 1055*b* extends in the direction of the first and second ends 1057, 1059 of the spacing member 1051 and between the first slot portion 1053*a*, 1055*a* and the third slot portion 1053*c*, 1055*c*.

As mentioned above, the pulley assembly 1014 also includes a first pulley 1020 and a second pulley 1020. The first pulley 1020 and the second pulley 1022 are respectively secured to the first and second ends 1043, 1045 of the pulley strap member 1041 at the second end 1037 of the coupling strap 1031. The first pulley 1020 is secured to the first end 1043 of the pulley strap member 1041 in a manner permitting a full range of motion of the first pulley 1020 relative to the first end 1043 of the pulley strap member 1041. Similarly, the second pulley 1022 is secured to the second end 1045 of the pulley strap member 1041 in a manner permitting a full range of motion of the second pulley 1022 relative to the pulley strap member 1041. A full range of motion is achieved by providing the first and second ends 1043, 1045 of the pulley strap member 1041 with pivotal bearing structures to which the first and second pulleys 1020, 1022 are respectively secured.

Considering now the first and second pulleys 1020, 1022, they are conventional pulleys and may take various forms. They are coated in rubber to prevent inadvertent damage to walls during use. In accordance with a preferred embodiment, each of the first and second pulleys 1020, 1022 includes a U-shaped frame member 1106. The U-shaped frame member 1106 includes a first end 1108 at the connection member 1110 coupling the first and second arms 1112, 1114 at a second end 1116 at the free ends of the first and second arms 1112. The first end 1108 includes a pivoting clasp 1118 to which the releasable coupling member 1102, 1104 is secured and the second end 1116 includes a pivot pin 1120 extending between the free ends of the first and second arms 1112, 1114 with a wheel 1122 rotating upon the pivot pin 1120.

As mentioned above, a first pulley cable 1024 is secured to the first pulley 1020 and a second pulley cable 1026 is secured to the second pulley 1022. With reference to the first pulley cable 1024, it passes within the space defined by the U-shaped frame member 1106 between the first end 1108, which is closed by the connection member 1110, and the second end 1116, which is closed by the pivot pin 1120 and wheel 1122. The first pulley cable 1024 is retained within the spaced defined by the U-shaped frame member 1106 by securing a first enlarged locking member 1124 adjacent the first end 1028 of the first pulley cable 1024 and a second enlarged locking member 1126 adjacent the second end 1030 of the first pulley cable 1024. The first and second enlarged locking members 1124, 1126 are larger than the space defined by the U-shaped frame member 1106 and the respective first and second ends 1028, 1030 of the first pulley cable 1024 may not be pulled through the space defined by the U-shaped frame member 1106 so as to effectively remove the first pulley cable 1024 from the first pulley 1020. Similarly, the second pulley cable 1026 is retained within the spaced defined by the U-shaped frame member 1106 by securing a first enlarged locking member 1128 adjacent the first end 1032 of the second pulley cable 1026 and a second enlarged locking member 1130 adjacent the second end 1034 of the second pulley cable 1026. The first and second enlarged locking members 1128, 1130 are larger than the space defined by the U-shaped frame member 1106 and the respective first and second ends 1032, 1034 of the second pulley cable 1026 may not be pulled through the space defined by the U-shaped frame member 106 so as to effectively remove the first pulley cable 1024 from the first pulley 1020.

As briefly discussed above, the first pulley cable 1024 includes a first end 1028 and second end 1030. A first handle 1036 is coupled to the first end 1028 of the first pulley cable 1024, at a position beyond the previously discussed first enlarged locking members 1124. The body engaging assembly 1040 is coupled to the second end 1030 of the first pulley cable 1024 at a position beyond the previously discussed second enlarged locking members 1126. The first handle 1036 and the body engaging assembly 1040 are releasably secured to the first pulley cable 1024. In accordance with a preferred embodiment, the second end 1030 of the first pulley cable 1024 and the body engaging assembly 1040 are provided with releasable coupling members 1073, 1069 shaped and dimensioned for selective engagement.

With regard to the second pulley cable 1026, it includes a first end and second end 1032, 1034. The second handle 1038 is coupled to the first end 1032 of the second pulley cable 1026 at a position beyond the previously discussed first enlarged locking members 1128. The body engaging assembly 1040 is coupled to the second end 1034 of the second pulley cable 1026 at a position beyond the previously discussed second enlarged locking members 1130. The body engaging assembly 1040 is releasably secured to the first pulley cable 1024. In accordance with a preferred embodiment, the second end 1034 of the second pulley cable 1026 and the body engaging assembly 1040 are provided with releasable coupling member 1075, 1071 shaped and dimensioned for selective engagement.

Considering now the body engaging assembly 1040, it is preferably a belt 1134 shaped and dimensioned for positioning about the waist of a user as he or she exercises. As such, the belt 1134 includes an elongated body 1136 with an inner surface 1138 and an outer surface 1140, as well as a first end 1142 and a second end 1144. The respective first end 1142 and second end 1144 are provided with first and second mating fastening members 1146, 1148 allowing for releasable attachment of the belt 1134 about the waist of a user.

In addition, the belt 1134 includes a first supplementary attachment member 1065 and a second supplementary attachment member 1067 secured to opposite sides of the belt 1134 on opposite sides of the location where the first and second mating fastening members 1046, 1048 meet to secure the belt 1134 about the waist of a user. Each of the first and second supplementary attachment members 1065, 1067 includes a releasable coupling member 1069, 1071 shaped and dimensioned for selective engagement with releasable coupling members 1073, 1075 secured to the second ends 1030, 1034 of the first and second pulley cables 1024, 1026 (or releasable coupling members 1320, 1324 of a central pulley assembly 1310 (see FIGS. 16, 17 and 18)) as discussed below in greater detail. The releasable coupling members 1069, 1071 of the belt 1134 are coupled to the belt 1134 via straps 1077, 1079 which are adjustable in their effective length. In particular, the first ends 1077*a*, 1079*a* of the straps 1077, 1079 for the first supplementary attachment member 1065 and a second supplementary attachment member 1067 are fixedly secured to the belt 1134. The second ends 1077*b*, 1079*b* of the straps 1077, 1079 for the first supplementary attachment member 1065 and a second supplementary attachment member 1067 are coupled to an adjustment mechanism 1081, 1083 integrated with the releasable coupling member 1069, 1071 allowing one to adjust the effective length from the first end 1077*a*, 1079*a* of the strap 1077, 1079 to the second end 1077*b*, 1079*b* of the strap 1077, 1079. The adjustment mechanism 1081, 1083 employed in accordance with the preferred embodiment is a dual slot arrangement known to those skilled in the art wherein a strap is passed through adjacent slots in a tortuous path to allow for selective adjustment without sacrificing strength necessary to hold the strap at a desired length. The ability to adjust the length of strap allows one to adjust the travel length during exercise to adjust for people of the different sizes.

With regard to the attachment of the second ends 1030, 1034 of the first and second pulley cables 1026, 1028 to the elongated body 1136 of the body engaging assembly 1040, the elongated body 1136 is constructed such that the releasable coupling members 1069, 1071 used in securing the second ends 1030, 1034 of the first and second pulley cables 1024, 1026 to the elongated body 1136 are positioned along the outer surface 1140 of the elongated body 1136, that is, the surface of the elongated body 1136 facing away from the user when the body engaging assembly 1040 is properly positioned about the waist of the user.

More particularly, the releasable coupling members 1069, 1071 are positioned such that they are substantially aligned with opposed side of the body along the front plane of the user's body; that is, the releasable coupling members 1069, 1071, when the belt 134 is properly secured about the user will be positioned at the left and right sides of the body As will be further appreciated when the variety of uses for the present exercise apparatus is explained below, and as discussed above, the belt 1134 includes an elastic feature allowing for positioning of the belt 1134 at various locations along the abdomen and torso of the user. In particular, the belt 1134 includes a left side panel 1162 adjacent the first end of belt 1134 and a right side panel 1164 adjacent the second end of the belt 1134. Each of the left side panel 1162 and the right side panel 1164 is provided with an elastic member 1162*a*, 1164*b* allowing for controlled expansion thereof. In addition, it is appreciated additional security can be achieved by extending a tether from the mounting assembly 1040 to the belt 1134.

Figure 16:
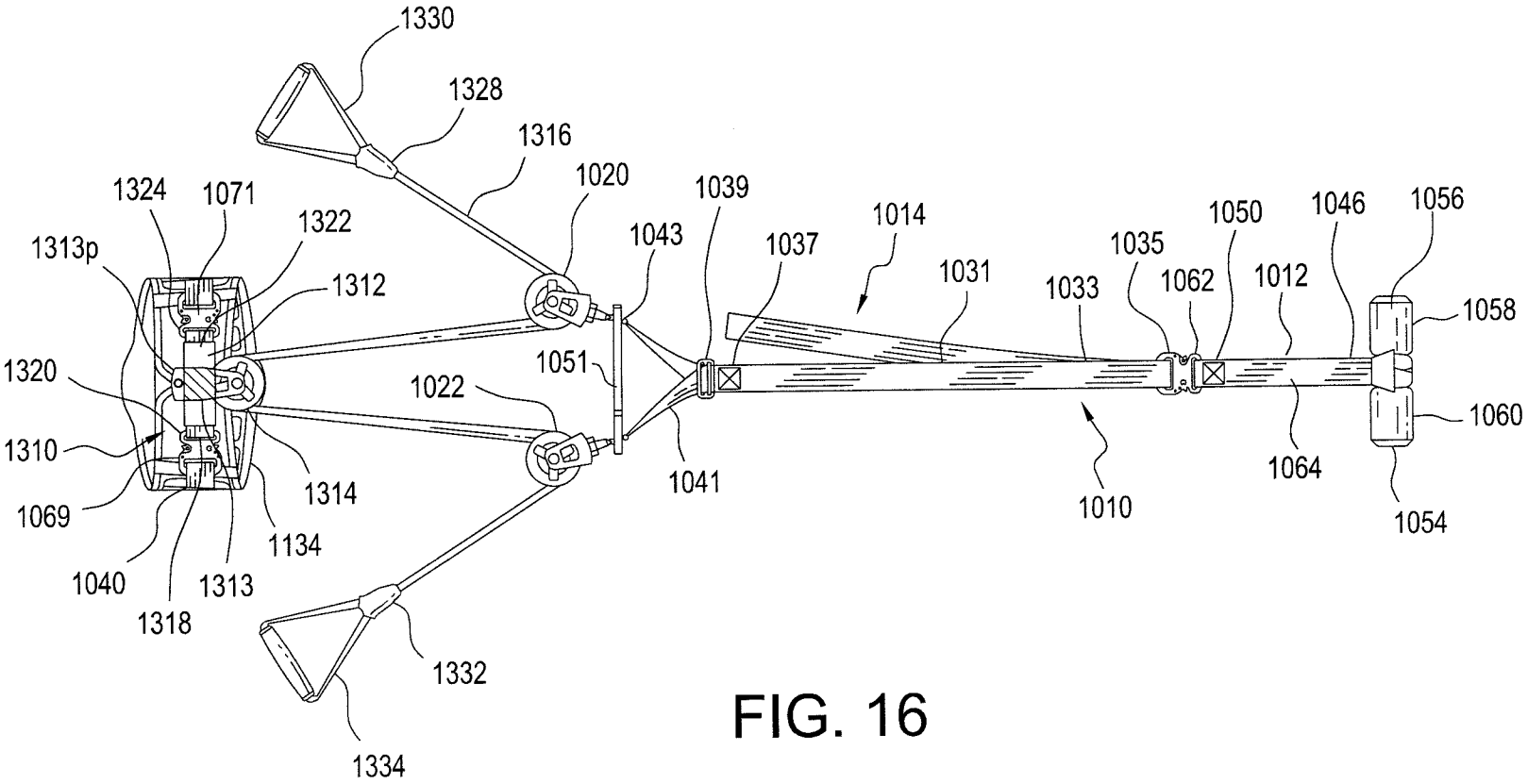
FIG. 16 is a top plan view of an exercise apparatus in accordance with the embodiment of FIG. 7 and with the central pulley assembly secured thereto.
Figure 17:
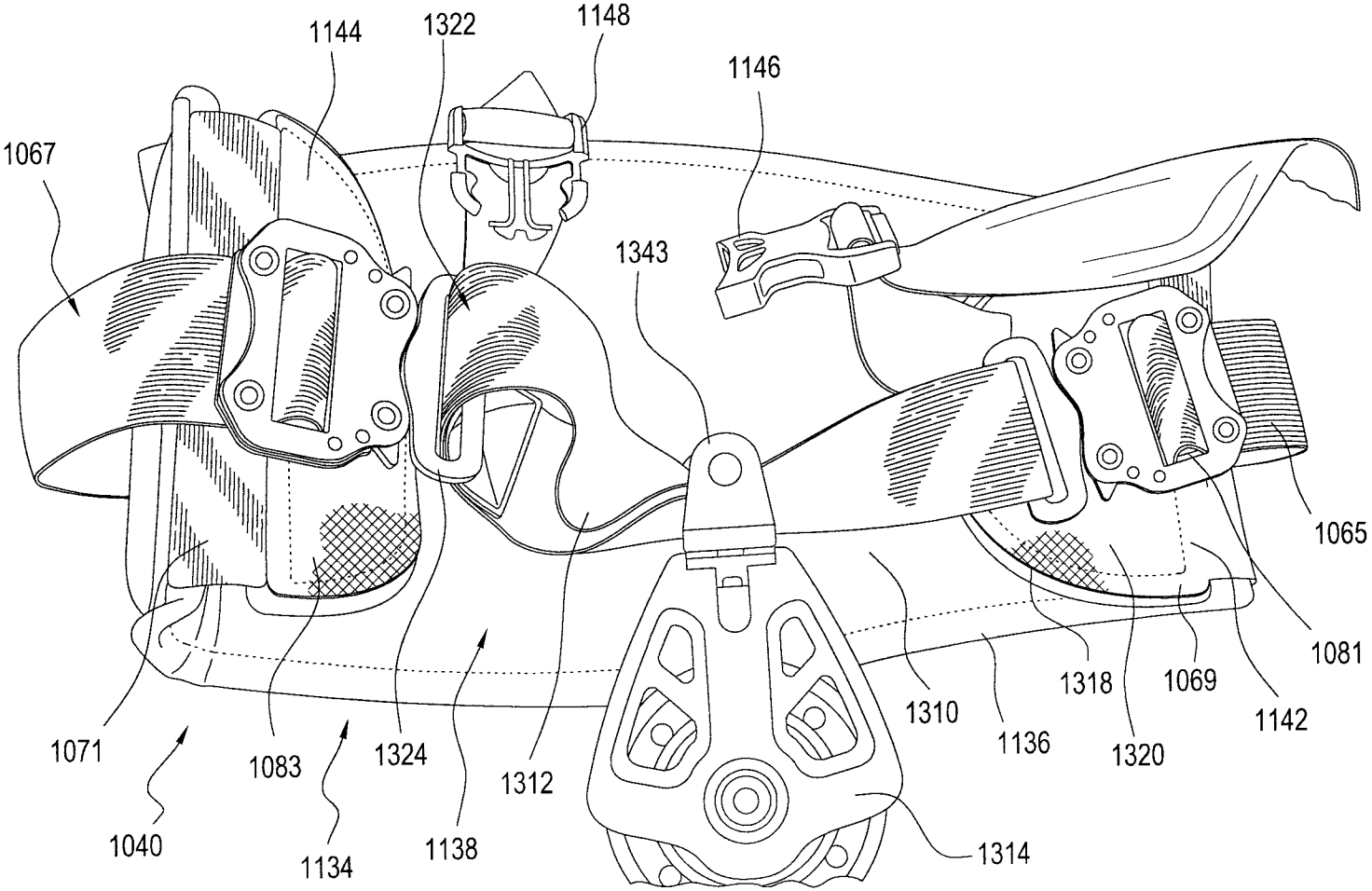
FIG. 17 is a top perspective view of the body engaging assembly in accordance with the embodiment of FIG. 7 with the central pulley assembly secured thereto.
Figure 18:
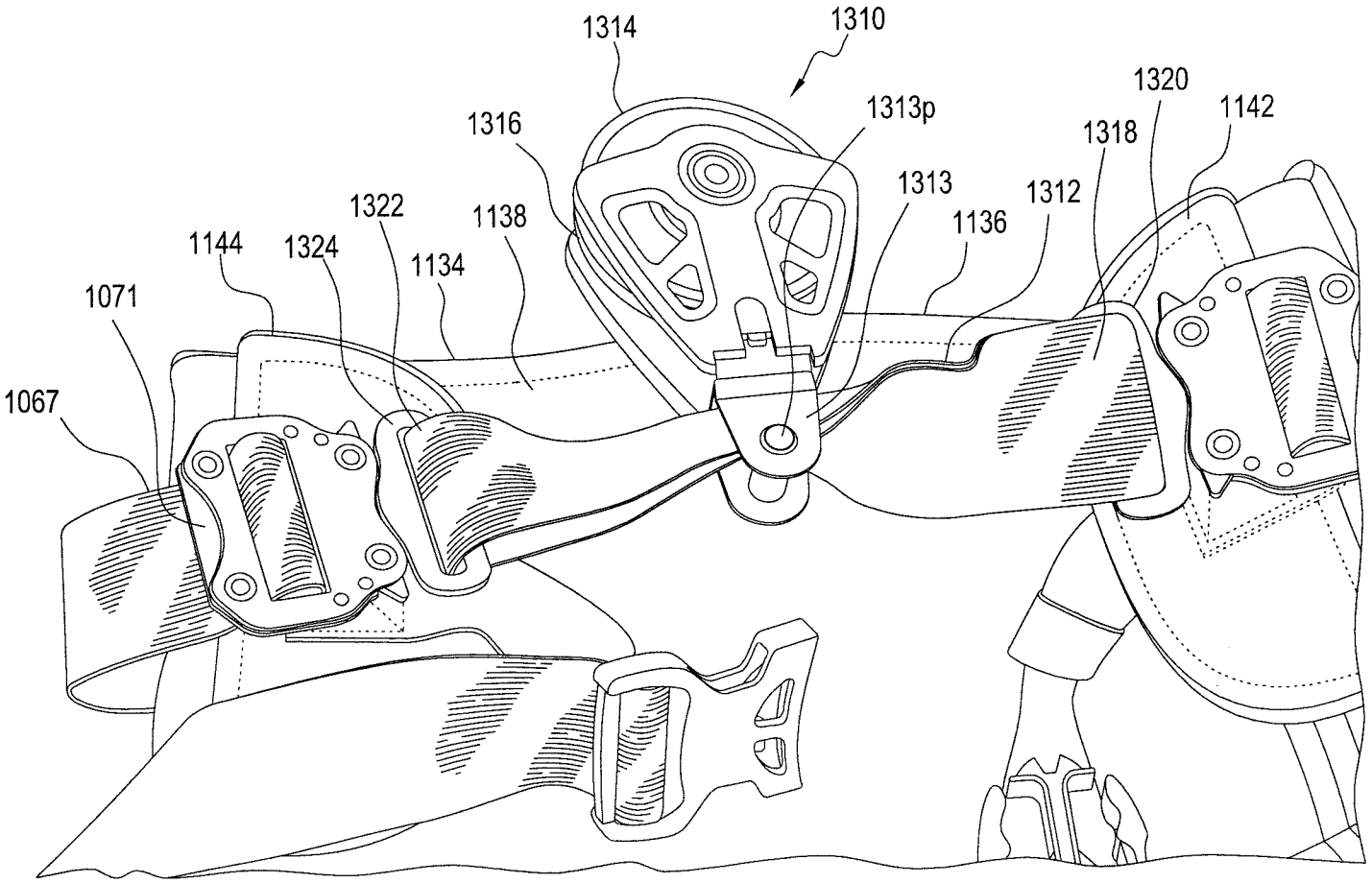
FIG. 18 is a top perspective view of the body engaging assembly in accordance with the embodiment of FIG. 7 with the central pulley assembly secured thereto (from an alternate perspective of that shown in FIG. 16.
Figure 19:
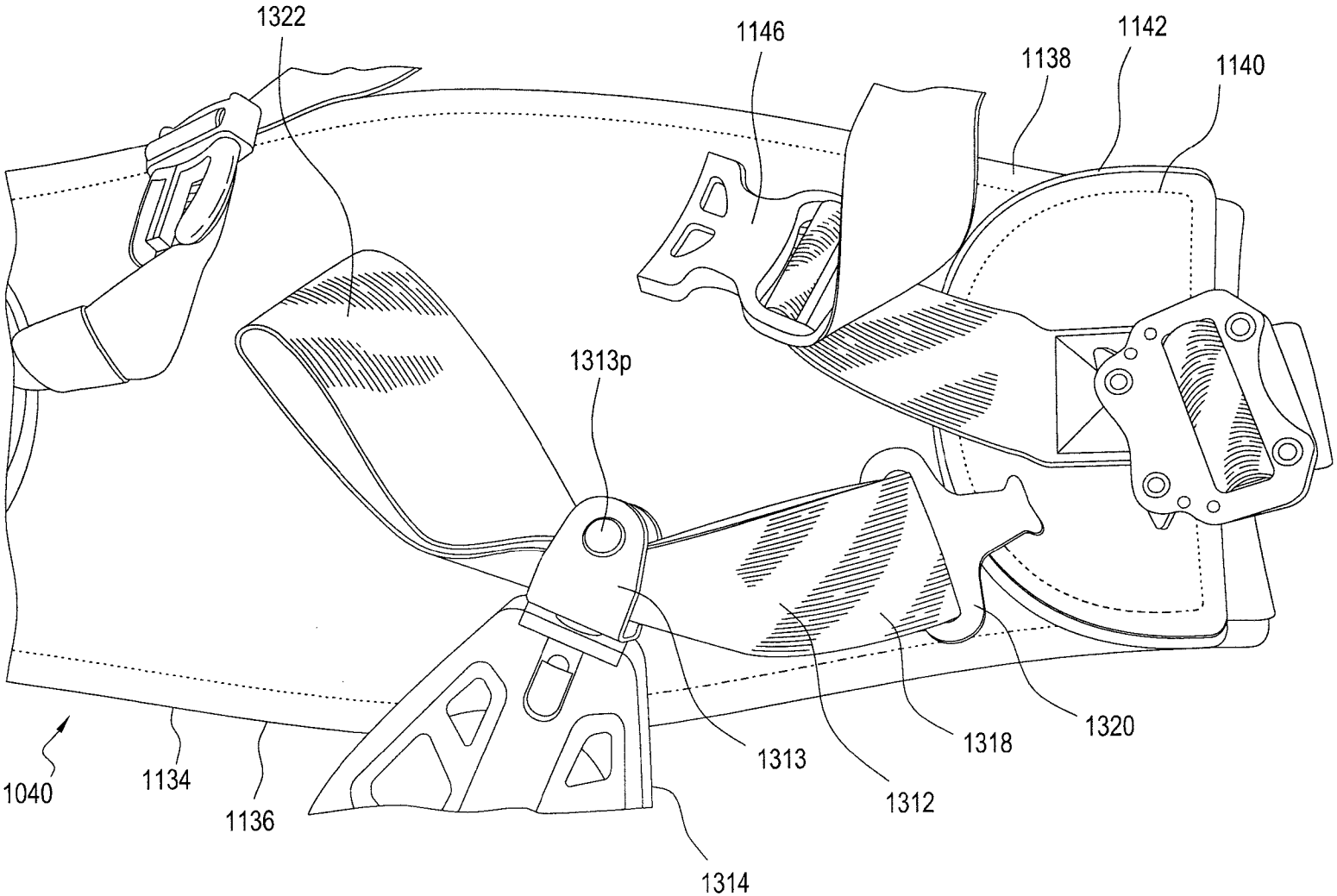
FIG. 19 is a detailed top perspective view of the body engaging assembly in accordance with the embodiment of FIG. 7 with the central pulley assembly detached therefrom.

Further versatility is achieved by the provision of a central pulley assembly 1310 (see FIGS. 16, 17 and 18). The central pulley assembly 1310 includes a short strap member 1312 to which a central pulley 1314 is secured. The central pulley 1314 is supported upon the short strap member 1312 via a bearing 1313 allowing for a wide range of motion. The bearing 1313 includes a removable pin 1313*p* allowing for release of the central pulley 1314 from the short strap member 1312. The remainder of the bearing 1313 is the same as the frame 1106 described above with regard to the first and second pulleys 1020, 1022. As will be appreciated based upon the following disclosure, the central pulley assembly 1310 allows for adjustment of the present exercise device from a dual pulley assembly to a single pulley assembly where a single pulley cable 1316 extends through a tortuous path joining the first pulley 1022, the second pulley 1022 and the central pulley assembly 1310.

The short strap member 1312 of the central pulley assembly 1310 includes a first end 1318 provided with a releasable coupling member 1320 adapted for attachment to the releasable coupling member 1069 on the left side of the belt 1134 and a second end 1322 provided with a releasable coupling member 1324 adapted for attachment to the releasable coupling member 1071 on the right side of the belt 1134. With the first and second ends 1318, 1322 of the central pulley assembly 1310 secured to the belt 1134, the central pulley 1314 is positioned across the front of the belt 1134 at a position along the abdomen of the user.

As mentioned above, this alternative uses a single pulley cable construction. The single pulley cable 1316 includes a first end 1328 to which is secured a handle 1330 and a second end 1332 to which is secured a handle 1334. Extending from the handle 1330 at the first end 1328 of the single pulley cable 1316, the single pulley cable 1316 passes around and the first pulley 1020, the central pulley 1314, and the second pulley 1022 where it ends with the handle at the second end of the single pulley.

Figure 20:
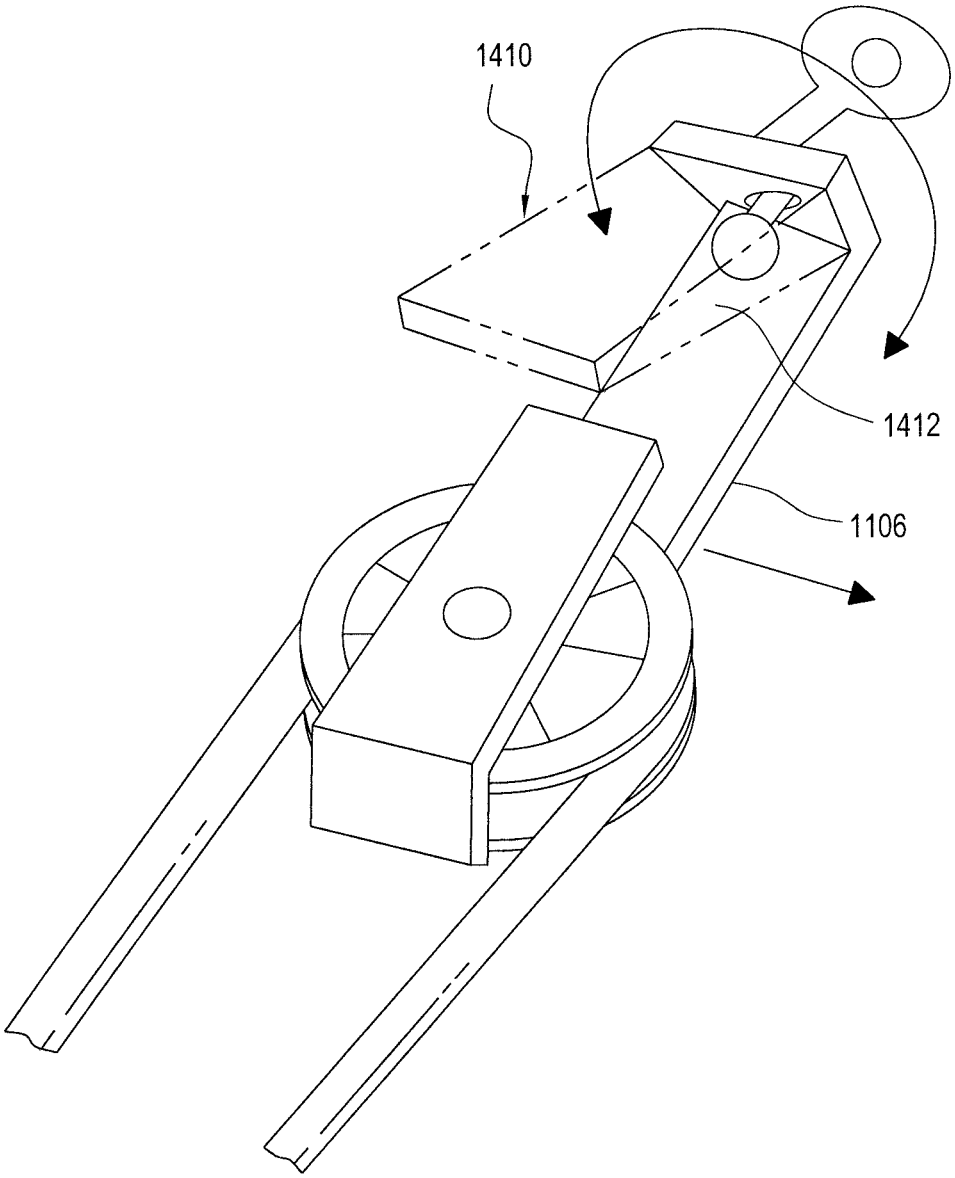
FIG. 20 is a detailed perspective view of pulley used in the embodiment of the FIG. 7.

Referring now to FIG. 20, in order to facilitate change between the two pulley system and the single pulley system, each of the first pulley 1020, the second pulley 1022 and the central pulley 1314 is provided with a hinged release plate 1410 (not visible in the other figures) allowing for removal of the cables that may be held within the pulley structure. The release plate 1410 is composed of a spring biased hinge member 1412 integrated into the U-shaped frame member 1106, and functions in much the same manner as a carabiner.

When it is time to exercise, the user removes the various functional components, that is, the mounting assembly and the pulley assembly. The abutment member is positioned the exterior side of the door and the strap is slid between the door and the door frame. In particular, the strap is slid between the door and the door frame from the top of the door such that the strap sits upon the upper hinge connecting the door to the door frame.

With the abutment member positioned on the exterior of the door and the strap extending to the interior of the door, the adjustable coupling strap is secured to the strap and the pulley assembly is secured to the adjustable coupling strap. The user then secures the body engaging assembly about his or her torso or waist depending upon the exercise. The pulley cable(s) are then secured to the attachment points of the body engaging assembly. At this point, the user may adjust the adjustable coupling strap to suit the specific exercise he/she plans to perform. In particular, the adjustable coupling strap is adjusted such that the user may use his/her complete weight from the ground up, meaning that he/she will lift his/her whole weight from the ground up, but spreading the load all over his/her body. Thereafter, the user may grip the handles and begin exercising. As a result, the user becomes the weight and can either lean forward or backward while performing various exercises. For example, the present exercising apparatus will allow him/her to do back, squats, shoulders, biceps, triceps etc. with his/her body functioning as the resistance weight.

In the case where he/she desires to do a chest workout, he/she may lean forward with the belt positioned at a comfortable position as shown in FIG. 5. When he/she is doing butterflies or he/she is doing push-ups or shoulders he/she can lean, he/she can go down and come up in one motion using his/her whole body. Because he/she is at an angle, his/her body has to flex all its front muscles to keep him/her straight up. He/she can do back exercises, upper chest exercises, lower chest exercises, sit-ups etc.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. An exercise apparatus, comprising:

a mounting assembly;

a pulley assembly coupled to the mounting assembly, the pulley assembly includes a pulley strap member having a first end secured to a first pulley and a second end secured to a second pulley, the pulley strap member being held by a spacing member such that the first end of the pulley strap member and the second end of the pulley strap member are held in a spaced relationship for holding the first pulley and the second pulley in a spaced relationship;

a pulley cable is positioned about the first pulley and the second pulley for movement relative thereto, the pulley cable includes a first end and a second end;

a first handle is coupled to the first end of the pulley cable; and a body engaging assembly is coupled to the pulley cable, wherein the body engaging assembly is a belt shaped and dimensioned for positioning about a waist of a user, the belt including an elongated body with an inner surface and an outer surface, as well as a first end and a second end, and the first end of the elongated body and the second end of the elongated body are provided with mating fastening members allowing for releasable attachment of the belt about the waist of a user.

2. The exercise apparatus according to claim 1, wherein the mounting assembly includes a first end and a second end, wherein the first end of the mounting assembly includes an abutment member and the second end of the mounting assembly includes a releasable coupling member allowing for selective attachment of the pulley assembly to the mounting assembly.

3. The exercise apparatus according to claim 2, wherein the pulley assembly further includes a coupling strap securing the pulley strap member to the mounting assembly.

4. The exercise apparatus according claim 1, wherein the belt also includes a first supplementary attachment member and a second supplementary attachment member secured to opposite sides of the belt on opposite sides of the first and second mating fastening members.

5. The exercise apparatus according to claim 4, wherein each of the first and second supplementary attachment members includes a releasable coupling member shaped and dimensioned for selective engagement with mating releasable coupling members.

6. The exercise apparatus according to claim 5, wherein the pulley cable includes a releasable coupling member for selective engagement with either of the first or second supplementary attachment members.

7. The exercise apparatus according to claim 5, further including a central pulley assembly including a releasable coupling member for selective engagement with either of the first or second supplementary attachment members.

8. The exercise apparatus according to claim 7, wherein the central pulley assembly includes a short strap member to which a central pulley is secured.

9. The exercise apparatus according to claim 8, wherein the short strap member includes a first end provided with a first short strap member releasable coupling member adapted for attachment to the releasable coupling member of the first supplementary attachment member and a second end provided with a second short strap member releasable coupling member adapted for attachment to the releasable coupling member of the second supplementary attachment member.

10. The exercise apparatus according to claim 5, wherein straps, adjustable in length, secure the releasable coupling members of the first and second supplementary attachment members to the belt.

11. An exercise apparatus, comprising:

a mounting assembly;

a pulley assembly coupled to the mounting assembly, the pulley assembly includes a pulley strap member having a first end secured to a first pulley and a second end secured to a second pulley, the pulley strap member being held by a spacing member such that the first end of the pulley strap member and the second end of the pulley strap member are held in a spaced relationship for holding the first pulley and the second pulley in a spaced relationship;

a pulley cable is positioned about the first pulley and the second pulley for movement relative thereto, the pulley cable includes a first end and a second end;

a first handle is coupled to the first end of the pulley cable; and a body engaging assembly is coupled to the pulley cable;

wherein the spacing member is an elongated planar member having a first end, a second end, and opposed first and second sidewalls extending between the first end and the second end, the spacing member further including a first slot through which the first end of the pulley strap member passes and a second slot through which the second end of the pulley strap member passes.

12. The exercise apparatus according to claim 11, wherein the first slot and the second slot are mirror images of each other.

13. The exercise apparatus according to claim 12, wherein each of the first slot and the second slot includes a first slot portion extending between the first sidewall and the second sidewall and being adjacent the first or second end of the spacing member, a second slot portion extending in a direction of the first end and the second end of the spacing member, and a third slot portion extending between the first sidewall and the second sidewall but being inward of either the first end or second end of the spacing member relative to the first slot portion.

14. An exercise apparatus, comprising:

a mounting assembly;

a pulley assembly coupled to the mounting assembly, the pulley assembly includes a first pulley and a second pulley;

a pulley cable is positioned about the first pulley and the second pulley for movement relative thereto, the pulley cable includes a first end and a second end;

a first handle is coupled to the first end of the pulley cable;

a body engaging assembly is coupled to the pulley cable, wherein the body engaging assembly is a belt shaped and dimensioned for positioning about a waist of a user, the belt including an elongated body with a first end with a first releasable coupling member and a second end with a second releasable coupling member; and a central pulley assembly selectively coupled with the body engaging assembly, the central pulley assembly includes a short strap member to which a central pulley is secured, the short strap member of the central pulley assembly includes a first end provided with a first short strap member releasable coupling member selectively attached to the first releasable coupling member of the belt and a second end provided with a second short strap member releasable coupling member selectively attached to the second releasable coupling member of the belt.

15. The exercise apparatus according to claim 14, wherein the mounting assembly includes a first end and a second end, wherein the first end of the mounting assembly includes an abutment member and the second end of the mounting assembly includes a releasable coupling member allowing for selective attachment of the pulley assembly to the mounting assembly.

16. The exercise apparatus according to claim 15, wherein the pulley assembly further includes a coupling strap securing the pulley strap member to the mounting assembly.

* * * * *